US009547263B2

(12) United States Patent
Soeda

(10) Patent No.: US 9,547,263 B2
(45) Date of Patent: Jan. 17, 2017

(54) FIXING DEVICE AND IMAGE FORMING APPARATUS

(71) Applicant: Oki Data Corporation, Tokyo (JP)

(72) Inventor: Teruo Soeda, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/295,635

(22) Filed: Jun. 4, 2014

(65) Prior Publication Data

US 2014/0369726 A1 Dec. 18, 2014

(30) Foreign Application Priority Data

Jun. 17, 2013 (JP) ..... 2013-126787

(51) Int. Cl.
*G03G 15/20* (2006.01)

(52) U.S. Cl.
CPC .. *G03G 15/2053* (2013.01); *G03G 2215/2022* (2013.01); *G03G 2215/2035* (2013.01); *G03G 2215/2038* (2013.01)

(58) Field of Classification Search
CPC ..... G03G 15/2053; G03G 2215/2022; G03G 2215/2035; G03G 2215/2038
See application file for complete search history.

(56) References Cited

U.S. PATENT DOCUMENTS

| | | | | |
|---|---|---|---|---|
| 6,456,819 | B1 * | 9/2002 | Abe | G03G 15/2064 219/216 |
| 2011/0222931 | A1 * | 9/2011 | Shinshi et al. | 399/329 |
| 2011/0262193 | A1 | 10/2011 | Kimura | |
| 2012/0177420 | A1 * | 7/2012 | Shimokawa et al. | 399/329 |
| 2013/0084088 | A1 * | 4/2013 | Sakai | 399/329 |

FOREIGN PATENT DOCUMENTS

| | | | |
|---|---|---|---|
| JP | 10-198200 | A | 7/1998 |
| JP | 2000-306655 | | 11/2000 |
| JP | 2002-299007 | A | 10/2002 |
| JP | 2005-165197 | A | 6/2005 |
| JP | 2006-078965 | A | 3/2006 |
| JP | 2007-033552 | A | 2/2007 |
| JP | 2011-257455 | A | 12/2011 |

* cited by examiner

*Primary Examiner* — Ryan Walsh
(74) *Attorney, Agent, or Firm* — Rabin & Berdo, P.C.

(57) ABSTRACT

A fixing device including a belt having an endless shape, a heater provided on an inner surface side of the belt, and a pressing portion provided so as to contact the belt and form a nip portion. A groove-forming portion is provided so as to contact the belt. The groove-forming portion has a surface and a groove formed on the surface. The groove extends in a direction crossing a rotating direction of the belt.

18 Claims, 10 Drawing Sheets

FIXING DEVICE AND IMAGE FORMING APPARATUS

BACKGROUND OF THE INVENTION

The present invention relates to a fixing device and an image forming apparatus such as an electrophotographic printer using the fixing device.

An image forming apparatus includes four image forming units arranged along a transport path of a recording sheet, and a transfer unit is provided so as to face the image forming units via the transport path. The image forming units form developer images of four colors, and the transfer unit transfers the developer images to the recording sheet. A fixing device is provided downstream of the image forming units in a transport direction of the recording sheet. The fixing unit is configured to fix the developer image to the recording sheet.

The fixing device includes a fixing roller, a metal guide, and an endless belt provided around the fixing roller and the metal guide. A heater is provided on a back surface of the belt guide. A pressure roller is pressed against the fixing roller via the endless belt. In an image forming operation, the fixing roller is driven to rotate, and the endless belt and the pressure roller rotate following the rotation of the fixing roller. The endless belt is heated by heat generated by the heater, and is transmitted from the fixing roller via the metal guide. The recording sheet (to which a developer image is transferred) is introduced into between the endless belt and the pressure roller, and the developer image is fixed to the recording sheet by being applied with heat and pressure (see, for example, Japanese Laid-open Patent Publication No. 2011-257455).

In the conventional fixing unit, there are cases where deterioration in image quality may occur.

SUMMARY OF THE INVENTION

An aspect of the present invention is intended to provide a fixing device and an image forming apparatus capable of enhancing image quality.

According to an aspect of the present invention, there is provided a fixing device including a belt having an endless shape, a heater provided on an inner surface side of the belt, a pressing portion provided so as to contact the belt and form a nip portion, and a groove-forming portion provided so as to contact the belt. The groove-forming portion has a surface and a groove formed on the surface. The groove extends in a direction crossing a rotating direction of the belt.

This configuration allows for enhancing image quality.

According to another aspect of the present invention, there is provided an image forming apparatus including the fixing device.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

<Configuration of Printer>

Figure 1:
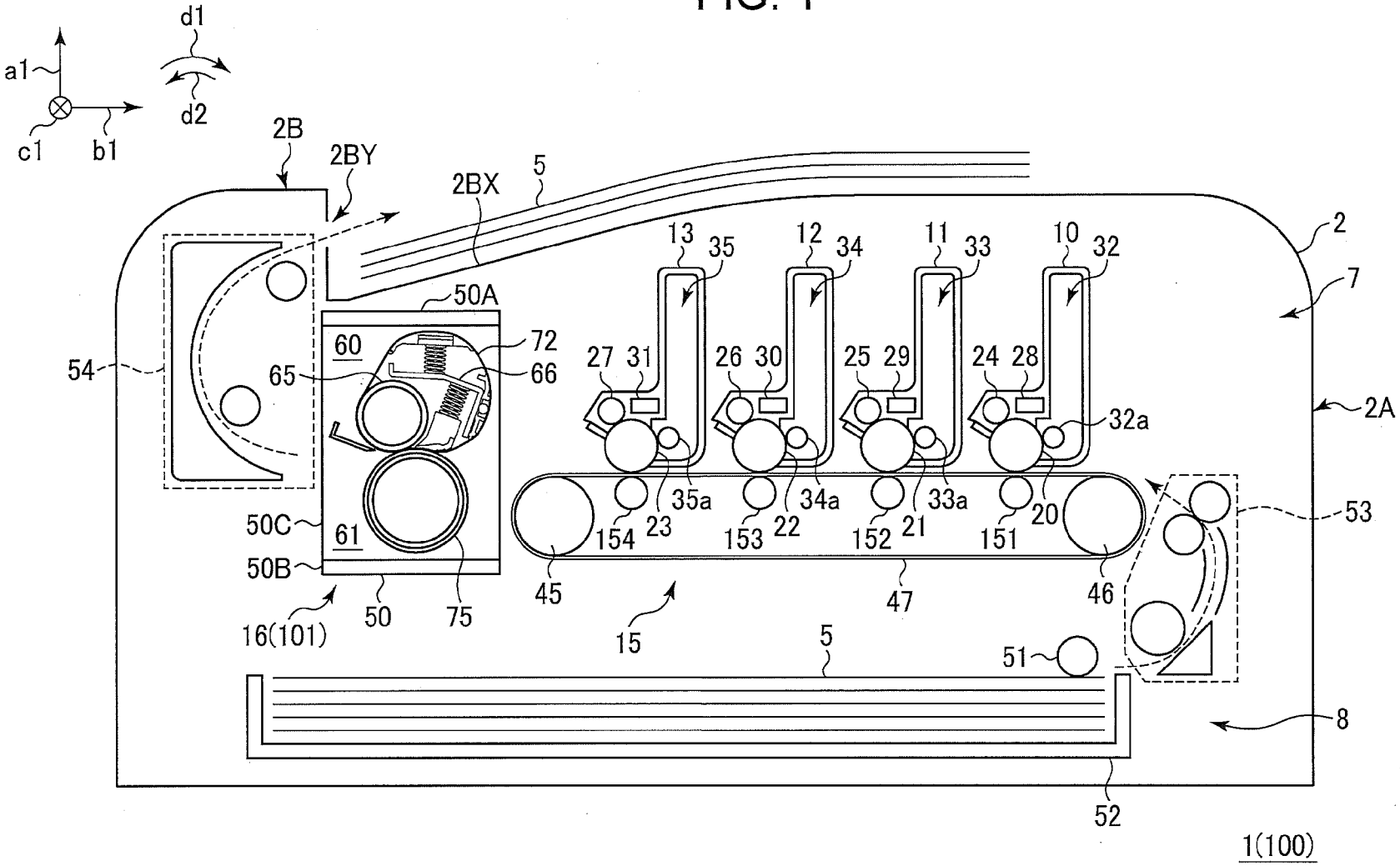
FIG. 1 is a schematic sectional view showing a configuration of a color printer according to the first embodiment of the present invention.

FIG. 1 is a perspective view showing a configuration of a color printer 1 as an image forming apparatus according to the first embodiment. The color printer 1 includes, for example, a casing 2 (referred to as a printer casing 2) having a substantially box-like shape.

Hereinafter, an upward direction (shown by an arrow a1) of the color printer 1 as seen by an observer facing a front surface 2A of the printer casing 2 is referred to as a printer-upward direction. A direction opposite to the printer-upward direction is referred to as a printer-downward direction. The printer-upward direction and the printer-downward direction are collectively referred to as a printer-vertical direction. Further, a printer-frontward direction (shown by an arrow b1) as seen by the observer facing the front surface 2A of the printer casing 2 is referred to as a printer-frontward direction. The direction opposite to the printer-frontward direction is referred to as a printer-rearward direction. The printer-frontward direction and the printer-rearward direction are collectively referred to as a printer-front-rear direction. Furthermore, a printer-left direction (shown by an arrow c1) as seen by the observer facing the front surface 2A of the printer casing 2 is referred to as a printer-left direction. The direction opposite to the printer-left direction is referred to as a printer-right direction. The printer-left direction and the printer-right direction are collectively referred to as a printer-crosswise direction.

The printer casing 2 has, for example, a recording sheet placing portion 2BX in the form of a convex portion. The recording sheet placing portion 2BX is formed on a rear part of a top cover 2B of the printer casing 2. The recording sheet placing portion 2BX is configured to receive a rectangular recording sheet 5 (i.e., a recording medium) on which an image has been formed.

The printer casing 2 has a sheet ejection opening 2BY through which the recording sheet 5 is ejected to the recording sheet placing portion 2BX. The sheet ejection opening 2BY is located at a rear side of the recording sheet placing portion 2BX.

An image forming section 7 is provided in a center part of the printer casing 2. The image forming section 7 transports the recording sheet 5 in a direction from a front side toward a rear side of the color printer 1, and forms an image (i.e., a color image) on a surface of the recording sheet 5. The image forming section 7 transports the recording sheet 5 in, for example, a short edge leading orientation (i.e., in such a manner that a short edge of the recording sheet 5 leads in the transport direction).

A sheet feeding unit 8 (also referred to as a feeding unit) is provided at a lower part of the printer casing 2. The sheet feeding unit 8 feeds (i.e., supplies) the recording sheet 5 to the image forming section 7. The sheet feeding unit 8 feeds the recording sheet 5 in, for example, the short edge leading orientation.

The image forming section 7 includes four image forming units 10, 11, 12 and 13 that form toner images (i.e., developer images) of black (K), yellow (Y), magenta (M) and cyan (C). Hereinafter, the image forming unit 10 that forms a black image is also referred to as a first image forming unit 10. The image forming unit 11 that forms a yellow image is also referred to as a second image forming unit 11. The image forming unit 12 that forms a magenta image is also referred to as a third image forming unit 12. The image forming unit 13 that forms a cyan image is also referred to as a fourth image forming unit 13.

The image forming section 7 further includes a transfer unit 15 configured to, for example, transport the recording sheet 5 in the direction from the front side toward the rear side of the printer casing 2, and transfer the toner images (formed on the recording sheet 5 by the image forming units 10, 11, 12 and 13) to the surface of the recording sheet 5 in an overlapping manner.

The image forming section 7 further includes a fixing unit 16 that fixes the toner image (transferred to the recording sheet 5 by the transfer unit 15) to the surface of the recording sheet 5.

The image forming units 10, 11, 12 and 13 are arranged at equal intervals in this order in the direction from the front side toward the rear side of the printer casing 2 (i.e., a direction in which the transfer unit 15 transports the recording sheet 5). The image forming units 10, 11, 12 and 13 are detachably mounted to the printer casing 2. The image forming units 10, 11, 12 and 13 have the same configurations except for toners (i.e., developers).

The image forming units 10, 11, 12 and 13 includes photosensitive drums 20, 21, 22 and 23 as image bearing bodies. The photosensitive drums 20, 21, 22 and 23 (also referred to as first, second, third and fourth photosensitive drums) are rotatable in one direction (i.e., clockwise in FIG. 1 as shown by an arrow d1) about rotation axes parallel to the printer-crosswise direction. Hereinafter, the rotating direction shown by the arrow d1 is referred to as a first rotating direction d1. A rotating direction (shown by an arrow d2) opposite to the first rotating direction is referred to as a second rotating direction d2.

The photosensitive drums 20, 21, 22 and 23 respectively have drum rotation shafts which are connected to an output shaft of image-forming-unit-driving motors (not shown) provided in the printer casing 2 via a plurality of gears. When the color printer 1 performs a printing operation, the image-forming-unit-driving motors rotate, and the photosensitive drums 20, 21, 22 and 23 rotate in the same direction about the drum rotation axes parallel to the printer-crosswise direction.

The image forming units 10, 11, 12 and 13 further include charging rollers 24, 25, 26 and 27 (i.e., charging members) that respectively charge surfaces of the photosensitive drums 20, 21, 22 and 23. The charging rollers 24, 25, 26 and 27 (also referred to as first, second, third and fourth charging rollers) rotate about rotation axes parallel to the printer-crosswise direction. The charging rollers 24, 25, 26 and 27 rotate in the second rotating direction d2 . In the printing operation, the charging rollers 24, 25, 26 and 27 rotate in the second rotating direction d2 following the rotations of the photosensitive drums 20, 21, 22 and 23.

The charging rollers 24, 25, 26 and 27 are electrically connected to charging-roller-power sources (not shown) provided in the printer casing 2. In the printing operation, the charging rollers 24, 25, 26 and 27 are applied with direct voltages (i.e., charging voltages), and charge the surfaces of the photosensitive drums 20, 21, 22 and 23 so that the photosensitive drums 20, 21, 22 and 23 can bear latent images.

The image forming units 10, 11, 12 and 13 further include exposure heads 28, 29, 30 and 31 (i.e., exposure units) that emit light to expose the surfaces of the photosensitive drums 20, 21, 22 and 23 to form latent images. The exposure heads 28, 29, 30 and 31 (also referred to as first, second, third and fourth exposure units) include LED (Light Emitting Diode) arrays and lens arrays. Each LED array includes a plurality of LED elements.

The image forming units 10, 11, 12 and 13 further include developing units 32, 33, 34 and 35 for developing the latent images on the photosensitive drums 20, 21, 22 and 23. The developing units 32, 33, 34 and 35 (also referred to as first, second, third and fourth developing units) and include developing rollers (i.e., developer bearing bodies) 32*a*, 33*a*, 34*a* and 35*a* and toner cartridges (i.e., developer storage bodies) storing the toners of respective colors. The developing rollers 32*a*, 33*a*, 34*a* and 35*a* are connected to developing-roller-power sources (not shown) provided in the printer casing 2. In the printing operation, the developing rollers 32*a*, 33*a*, 34*a* and 35*a* are applied with direct voltages (i.e., developing voltages), and develop the latent images on the photosensitive drums 20, 21, 22 and 23 to form toner images (i.e., developer images).

The transfer unit 15 is provided in the center part of the printer casing 2 so as to face the image forming units 10, 11, 12 and 13. The transfer unit 15 includes a driving roller 45 and a tensioning roller 46 respectively provided on the front side and the rear side. The driving roller 45 and the tensioning roller 46 are rotatable the second rotating direction d2 about rotation axes parallel to the printer-crosswise direction.

The transfer unit 15 further includes a transfer belt 47 that transports the recording sheet 5 for transferring the toner image from the image forming units 10, 11, 12 and 13. The transfer belt 47 is stretched around the driving roller 45 and the tensioning roller 46. The transfer belt 47 has upper and lower flat portions extending between the driving roller 45 and the tensioning roller 46. The upper flat portion of the transfer belt 47 contacts the photosensitive drums 20, 21, 22 and 23 at four positions.

The four positions on the upper flat portion of the transfer belt 47 contacting the photosensitive drums 20, 21, 22 and 23 are referred to as transfer positions (also referred to as first, second, third and fourth transfer positions).

The driving roller 45 has a rotation shaft connected to a transfer-unit-driving motor (not shown) provided in the printer casing 2 via a plurality of gears. In the printing operation, the transfer-unit-driving motor rotates, and the driving roller 45 rotates in the second rotating direction d2. As the driving roller 45 rotates in the second rotating direction d2 , the tensioning roller 46 and the transfer belt 47 also rotate in the second rotating direction d2.

The transfer unit 15 further includes transfer rollers 151, 152, 153 and 154 provided on an inner surface side of the transfer belt 47. The transfer rollers 151, 152, 153 and 154 are provided so as to face the photosensitive drums 20, 21, 22 and 23 via the transfer belt 47. The transfer rollers 151, 152, 153 and 154 are connected to transfer-roller-power sources (not shown) provided in the printer casing 2. In the printing operation, the transfer rollers 151, 152, 153 and 154 are applied with direct voltages (i.e., transfer voltages), and transfer the toner images from the photosensitive drums 20, 21, 22 and 23 to the recording sheet 5 on the transfer belt 47.

The fixing unit 16 includes a casing 50 (referred to as a unit casing 50) having a substantially rectangular tubular shape. The unit casing 50 includes, for example, a top plate 50A and a bottom plate 50B each having a substantially strip shape (i.e., an elongated shape). A pair of side plates 50C (one of which is not shown) having substantially rectangular shapes are provided on both ends of the top plate 50A and 50B. The fixing unit 16 includes a plurality of components (housed in the unit casing 50) for applying heat and pressure to the recording sheet 5, which will be described in detail later.

The fixing unit 16 is detachably mounted to the printer casing 2 so that a longitudinal direction of the unit casing 50 (i.e., a longitudinal direction of the top plate 50A and the bottom plate 50B) coincides with the printer-crosswise direction. The fixing unit 16 is located on the rear side of the fourth image forming unit 13 and the transfer unit 15, i.e., located downstream of the fourth image forming unit 13 and the transfer unit 15 along the transport direction of the recording sheet 5. The unit casing 50 has two openings, i.e., a recording sheet entry opening and a recording sheet exit opening. The recording sheet entry opening of the unit casing 50 faces the fourth image forming unit 13 and the transfer unit 15. The recording sheet exit opening of the unit casing 50 faces rearward. One of the side places 50C located on the left side of the unit casing 50 is referred to as a left side plate 50C. The other of the side plates 50C located on the right side of the unit casing 50 is referred to as a right side plate 50C.

The sheet feeding unit 8 includes a feeding tray 52 in which a plurality of the recording sheets 5 are set (i.e., stored). The recording sheets 5 are set in the feeding tray 52 in such an orientation that, for example, longer edges of the recording sheets 5 are parallel to the printer-front-rear direction. The sheet feeding unit 8 further include a feeding roller 51 that feeds each recording sheet 5.

The feeding tray 52 can be, for example, pulled out from the printer casing 2 and retracted into the printer casing 2. The feeding roller 51 is provided, for example, above a front end of the feeding tray 52, and is rotatable in the second rotating direction d2 about a rotation axis parallel to the printer-crosswise direction. The feeding roller 51 has a feeding roller rotation shaft connected to a feeding-driving motor (not shown) provided in the printer casing 2 via a plurality of gears. When the color printer 1 performs the printing operation, the feeding-driving motor rotates, and the feeding roller 51 rotates in the second rotating direction d2.

A feeding transport unit 53 is provided in the printer casing 2. The feeding transport unit 53 extends from the vicinity of an upper front part of the feeding tray 52 to the vicinity of a front part of the first image forming unit 10 and the transfer unit 15. The feeding transport unit 53 transports the recording sheet 5 (fed out from the feeding tray 52) to the image forming section 7. The feeding transport unit 53 includes a plurality of transport rollers, a plurality of guide members and a transport motor or the like. The feeding transport unit 53 forms a feeding transport path along which the recording sheet 5 is transported from the feeding tray 52 to the image forming section 7.

An ejection transport unit 54 is provided in the printer casing 2. The ejection transport unit 54 extends from the vicinity of a rear part of the fixing unit 16 to the vicinity of the sheet ejection opening 2BY. The ejection transport unit 54 ejects the recording sheet 5 with the fixed image through the sheet ejection opening 2BY. The ejection transport unit 54 includes a plurality of transport rollers, a plurality of guide members and a transport motor or the like. The ejection transport unit 54 forms an ejection transport path through which the recording sheet 5 is transported from the fixing unit 16 to the sheet ejection opening 2BY.

A control unit (not shown) such as a microcomputer or a CPU (Central Processing Unit) is provided in the printer casing 2. The control unit controls an entire operation of the color printer 1. The color printer 1 is connected to a host device (not shown) such as a personal computer via a wired or wireless connection. The control unit receives print command and image data (i.e., an object of printing) sent from the host device, and performs the printing operation (i.e., image formation) to form an image on the recording sheet 5.

When the control unit performs the printing operation, the control unit creates head control data (also referred to as first, second, third and fourth head control data) for respectively controlling the exposure heads 28, 29, 30 and 31 based on black, yellow, magenta and cyan components of the color image according to the image data sent from the host device.

Further, the control unit drives the image-forming-unit-driving motors to rotate the photosensitive drums 20, 21, 22 and 23 of the image forming units 10, 11, 12 and 13. The control unit also drives the transfer-unit-driving motor to rotate the transfer belt 47 of the transfer unit 15. The control unit also causes the charging-roller-power sources and the developing-roller-power sources to apply the charging voltages and the developing voltages to the charging rollers 24, 25, 26 and 27 and the developing rollers 32*a*, 33*a*, 34*a* and 35*a* of the image forming units 10, 11, 12 and 13. The control unit also causes the transfer-roller-power sources to apply the transfer voltages to transfer rollers 151, 152, 153 and 154 of the transfer unit 15. The control unit also drives a fixing-unit-driving motor (not shown) and a heater-power source (not shown) provided in the printer casing 2 to cause the fixing unit 16 to apply heat and pressure to the recording sheet 5 as described later.

Then, the control unit drives the transport motor to drive the feeding transport unit 53 and the ejection transport unit 54, and drives the feeding-driving motor to rotate the feeding roller 51. The feeding roller 51 feeds one recording sheet 5 out of the feeding tray 52. The feeding transport unit 53 transports the recording sheet 5 to the image forming section 7 along the feeding transport path.

While the recording sheet 5 is transported toward the image forming section 7, the control unit checks whether the recording sheet 5 reaches a passage sensor (i.e., a passage detection unit) provided along the feeding transport path. If the control unit detects that the recording sheet 5 reaches the passage sensor, the control unit sends the first, second, third and fourth head control data to the exposure heads 28, 29, 30 and 31 at timings before the recording sheet 5 reaches the first, second, third and fourth transfer position.

In the first image forming unit 10, the first exposure head 28 starts forming a latent image on the surface of the first photosensitive drum 20 based on the first head control data, and the developing unit 32 starts developing the latent image with black toner, before the recording sheet 5 reach the first transfer position. Similarly, in the second image forming unit 11, the second exposure head 29 starts forming a latent image on the surface of the second photosensitive drum 21 based on the second head control data, and the developing unit 33 starts developing the latent image with yellow toner, before the recording sheet 5 reach the second transfer position. In the third image forming unit 12, the third exposure head 30 starts forming a latent image on the surface of the third photosensitive drum 22 based on the third head control data, and the developing unit 34 starts developing the latent image with magenta toner, before the recording sheet 5 reach the third transfer position. In the fourth image forming unit 13, the fourth exposure head 31 starts forming a latent image on the surface of the fourth photosensitive drum 23 based on the fourth head control data, and the developing unit 35 starts developing the latent image with cyan toner, before the recording sheet 5 reach the fourth transfer position.

When the recording sheet 5 reaches the transfer unit 15, the recording sheet 5 is held on the transfer belt 47, and is transported by the transfer belt 47. As the recording sheet 5 passes through the first transfer position between the first photosensitive drum 20 and the transfer belt 47, the black toner image is transferred from the first photosensitive drum 20 to the recording sheet 5.

Similarly, as the recording sheet 5 passes through the second transfer position between the second photosensitive drum and the transfer belt 47, the yellow toner image is transferred from the second photosensitive drum 21 to the recording sheet 5. As the recording sheet 5 passes through the third transfer position between the third photosensitive drum 22 and the transfer belt 47, the magenta toner image is transferred from the third photosensitive drum 22 to the recording sheet 5. As the recording sheet 5 passes through the fourth transfer position between the fourth photosensitive drum 23 and the transfer belt 47, the magenta toner image is transferred from the fourth photosensitive drum 23 to the recording sheet 5. As a result, black, yellow, magenta and cyan toner images are transferred to the recording sheet 5 in an overlapping manner. The recording sheet 5 is further transported by the transfer belt 47 to reach the fixing unit 16.

The fixing unit 16 applies heat and pressure to the recording sheet 5 under control of the control unit. The toner image on the surface of the recording sheet 5 is molten and fixed to the surface of the recording sheet 5. The recording sheet 5 is fed out of the fixing unit 16, and then transported by the ejection transport unit 54. The ejection transport unit 54 transports the recording sheet 5 to the sheet ejection opening 2BY, and ejects the recording sheet 5 through the sheet ejection opening 2BY. The ejected recording sheet 5 is placed on the recording sheet placing portion 2BX so that a user can take the recording sheet 5 with the toner image being formed.

<Configuration of Fixing Unit>

A configuration of the fixing unit 16 (i.e., a fixing device) will be described in detail. The unit casing 50 is configured so that a width between inner surfaces of the left and right side plates 50C is longer than a width of the recording sheet 5 (also referred to as a recording-sheet-width) by a predetermined length.

The recording-sheet-width is a dimension of an edge of the recording sheet 5 in a direction perpendicular to the transport direction of the recording sheet 5, i.e., in a direction parallel to the printer-crosswise direction. For example, if the rectangular recording sheet 5 is fed in the short edge leading orientation (i.e., in such a manner that one of the short edges faces upstream, and the other of the short edges faces downstream in the transport direction of the recording sheet 5), the recording-sheet-width is a dimension of the short edge.

Hereinafter, an inner surface of the left side plate 50C is referred to as a left inner surface. An inner surface of the right side plate 50C is referred to as a right inner surface. An outer surface of the left side plate 50C is referred to as a left outer surface. An outer surface of the right side plate 50C is referred to as a right outer surface. A width between the left inner surface and the right inner surface is referred to as a casing-inner-width. A width between the left outer surface and the right outer surface is referred to as a casing-outer-width. The longitudinal direction of the unit casing 50 (i.e., a direction from the left side plate 50C to the right side plates 50C), which is parallel to the casing-inner-width and the casing-outer-width, is referred to as a unit-widthwise direction. A direction from the bottom plate 50B toward the top plate 50A of the unit casing 50 is referred to as a unit-upward direction. A direction from the top plate 50A toward the bottom plate 50B of the unit casing 50 is referred to as a unit-downward direction. The unit-upward direction and the unit-downward direction are collectively referred to as a unit-vertical direction.

Figure 2:
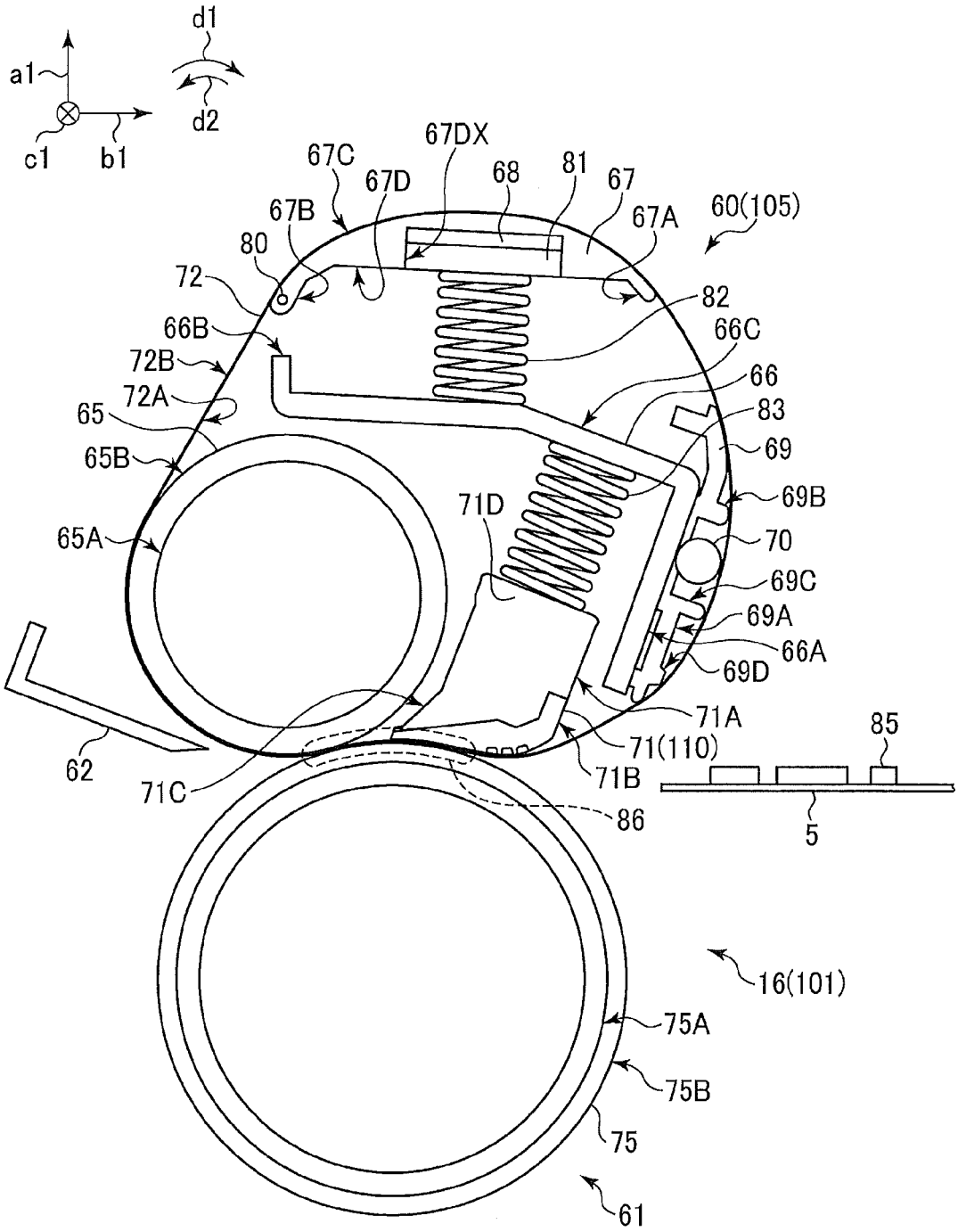
FIG. 2 is a schematic view showing a configuration of a fixing unit according to the first embodiment.

A heating section 60 and a pressure section 61 are provided adjacent to each other in the unit casing 50 (omitted in FIG. 2). The heating section 60 is located above the pressure section 61. The heating section 60 is provided for heating the recording sheet 5. The pressure section 61 is provided for pressing the recording sheet 5 in cooperation with the heating section 60. A separating portion 62 is provided on a rear side of a contact portion between the heating section 60 and the pressure section 61.

The heating section 60 includes a belt driving roller 65, a supporting portion 66, a heat transfer portion 67, a heater 68, a belt guide 69, a temperature sensor 70, a pressing portion 71, and a belt 72. The belt driving roller 65 is provided for driving the belt 72. The belt 72 is provided for heating and pressing the recording sheet 5, and therefore is referred to as a heating-and-pressing belt 72. The pressure section 61 includes a pressure roller 75 for pressing the recording sheet 5.

The belt driving roller 65 includes, for example, a cylindrical metal core 65A having a predetermined diameter, and a resilient layer 65B formed on an outer circumferential surface of the metal core 65A. The resilient layer 65B is formed of a sponge or rubber, and has a substantially uniform thickness. The belt driving roller 65 has a width between both end surfaces (referred to as a driving-roller-width). The driving-roller-width is wider than the recording-sheet-width, and is slightly shorter than the casing-inner-width. An outer diameter of the belt driving roller 65 is uniform throughout the driving-roller-width. A direction from the end surface to the other end surface of the belt driving roller 65 (and an opposite direction thereto) along the driving-roller-width is referred to as a driving-roller-widthwise direction.

The belt driving roller 65 includes, for example, a pair of driving roller rotation shafts (not shown). The driving roller rotation shafts are provided on both end surfaces of the belt driving roller 65, and are coaxial with each other, and aligned with a center axis of the belt driving roller 65. Rotary bearings (referred to as driving rotary bearings) for the belt driving roller 65 are provided at predetermined positions on the left and right side plates 50C so as to face each other.

The driving roller rotation shafts (i.e., left and right driving roller rotation shafts) of the belt driving roller 65 are mounted to the driving roller rotary bearings of the left and right side plates 50C in such a manner that the driving-roller-widthwise direction is parallel to the unit-widthwise direction (i.e., the printer-crosswise direction). Therefore, the belt driving roller 65 is rotatably supported by the unit casing 50 via the driving roller rotary bearings about a rotation axis parallel to the unit-widthwise direction (i.e., the printer-crosswise direction). The belt driving roller 65 rotates in the first rotating direction d1.

A rotation transmission mechanism (not shown) is provided in the printer casing 2. The rotation transmission mechanism is, for example, located so as to face one of the side plates 30C (for example, the right side plate). The rotation transmission mechanism transmits a rotation of an output shaft of the fixing-unit-driving motor to the belt driving roller 65 so as to rotate the belt driving roller 65 in the first rotating direction d1 . The rotation transmission mechanism is connected to the one of the driving roller rotation shafts (i.e., the right driving roller rotation shaft) of the belt driving roller 65 via a driving roller link mechanism (not shown) provided on one of the right side plates 30C (for example, the right side plate 30C) of the unit casing 50. The rotation transmission mechanism also transmits the rotation of the output shaft of the fixing-unit-driving motor to the pressure roller 75 so as to rotate the pressure roller 75 in the second rotating direction d2.

When the fixing unit 16 is mounted to the color printer 1, the right driving roller rotation shaft of the belt driving roller 65 is connected to the rotation transmission mechanism via the driving roller link mechanism. In the printing operation, the belt driving roller 65 of the heating section 60 is driven to rotate by the fixing-unit-driving motor in the first rotating direction d1.

The supporting portion 66 includes, for example, a plate member elongated in the unit-widthwise direction. The plate member has an S-shaped cross section, and has two edge portions 66A and 66B which are bent in opposite directions to each other. A longitudinal direction of the supporting portion 66, which is parallel to the unit-widthwise direction, is referred to as a supporting-portion-widthwise direction.

A width (referred to as a supporting-portion-width) between end surfaces of the supporting portion 66 in the supporting-portion-widthwise direction is, for example, substantially the same as the casing-inner-width. A length from a root (i.e., a bending position) of the edge portion 66A to a tip of the supporting portion 66 is longer than a length from a root of the edge portion 66B to the other tip of the supporting portion 66.

End surfaces of the supporting portion 66 are respectively fixed to the left and right inner surfaces of the side plates 50C of the unit casing 50 so that the supporting-portion-widthwise direction is parallel to the unit-widthwise direction (i.e., the printer-crosswise direction). The edge portion 66A is directed obliquely downward, and is located on a front side of the belt driving roller 65. The edge portion 66B is directed upward, and is located above the belt driving roller 65. The edge portion 66A located on a relatively front side is referred to as a front edge portion 66A, and the edge portion 66B located on a relatively rear side is referred to as a rear edge portion 66B.

The heat transfer portion 67 is formed of, for example, metal having a high thermal conductivity such as aluminum. The heat transfer portion 67 has a substantially hog-backed shape in cross section, and extends in the unit-widthwise direction. A longitudinal direction of the heat transfer portion 67, which is parallel to the unit-widthwise direction, is referred to as a transfer-portion-widthwise direction.

A width (referred to as a transfer-portion-width) between end surfaces of the heat transfer portion 67 in the transfer-portion-widthwise direction is, for example, substantially the same as the driving-roller-width. Projecting portions 67A and 67B are provided on edge portions of the heat transfer portion 67. The heat transfer portion 67 has a surface 67C extending between the projecting portions 67*a* and 67B. The surface 67C has a circular-arc shape or an arcuate shape.

The heat transfer portion 67 has a back surface 67D extending between the projecting portions 67A and 67B. The back surface 67D is a flat surface. A heater arrangement groove 67DX is formed at a center portion of the back surface 67D. The heater arrangement groove 67DX extends between end surfaces of the heat transfer portion 67 in the transfer-portion-widthwise direction. The heater arrangement groove 67DX has a predetermined depth and a predetermined width. A pair of cylindrical rotation shafts 80 (one of which is not shown) having predetermined lengths are provided on the end surfaces of the heat transfer portion 67 so as to face each other. The rotation shafts 80 are located in the vicinity of a tip of the projecting portion 67B. A pair of circular supporting holes (not shown) are provided on the left and right inner surfaces of the side plates 50C of the unit casing 50 so as to face each other. The supporting holes are located at positions corresponding to the rotation shafts 80 and above the rear edge portion 66B of the supporting portion 66.

The rotation shafts 80 are respectively inserted into the supporting holes on the left and right inner surfaces of the side plates 50C of the unit casing 50. The transfer-portion-widthwise direction is parallel to the unit-widthwise direction (i.e., the printer-crosswise direction). The surface 67C faces upward. The projecting portion 67B having the rotation shafts 80 is located on a rear side relative to the portion 67A. Therefore, the heat transfer portion 67 is rotatably supported by the unit casing 50 via the rotation shafts 80 inserted into the supporting holes of the left and right side plates 50C. The heat transfer portion 67 is rotatable in first and second rotating directions d1 and d2 about a rotation axis parallel to the unit-widthwise direction (i.e., the printer-crosswise direction).

The heater 68 has a substantially strip shape, and is mounted in the heater arrangement groove 67DX on the back surface 67D of the heat transfer portion 67. The heater 68 has a predetermined length longer than the transfer-portion-width. The heater 68 is provided in such a manner that, for example, an end of the heater 68 in the longitudinal direction is aligned with one end surface of the heat transfer portion 67, and a terminal (not shown) provided on the other end of the heater 68 protrudes from the other end surface of the heat transfer portion 67.

The heater 68 includes, for example, a main body including a plurality or layers and a resistance wire (not shown) buried in the main body. The resistance wire has substantially the same length as the transfer-portion-width. The resistance wire extends between both ends of the heater arrangement groove 67DX. The resistance wire is connected to an interconnection wiring (not shown) buried in the main body of the heater 68. The terminal is connected to the resistance wire via the interconnection wiring. When the fixing unit 16 is mounted to the color printer 1, the terminal of the heater 68 is electrically connected to the above described heater-power source provided in the printer casing 2.

The pressure plate 81 is fitted into the heater arrangement groove 67DX of the back surface 67D so as to cover the heater 68. The pressure plate 81 has a substantially strip shape, and has a substantially the same length as the transfer-portion-width. The pressure plate 81 is fitted in such manner that, for example, both ends of the pressure plate 81 are aligned with both end surfaces of the heat transfer portion 67. A plurality of compression coil springs 82 (referred to as biasing coil springs) are provided for biasing the heat transfer portion 67 in the second rotating direction D2. The compression coil springs 82 are arranged at equal intervals in the unit-widthwise direction. One ends of the compression coil springs 82 engage the lower surface of the pressure plate 81. The other ends of the compression coil springs 82 (opposite to those engaging the pressure plate 81) are supported on an upper surface of a center portion 66C of the supporting portion 66.

The belt guide 69 includes, for example, a plate portion 69A elongated in the unit-widthwise direction and having a substantially J-shaped cross section. A plurality of ribs 69B, 69C and 69D protrude from a surface of the plate portion 69A, and are arranged at equal intervals. The ribs 69B, 69C and 69D extend between both edge portions of the plate portion 69A in a longitudinal direction of the plate portion (i.e., the unit-widthwise direction). The longitudinal direction of the belt guide 69, which is parallel to the unit-widthwise direction, is referred to as a guide-widthwise direction.

In this case, the belt guide 69 is integrally formed of, for example, resin having a relatively low thermal conductivity. A width (referred to as a guide-width) between both ends of the belt guide 69 in the guide-widthwise direction is substantially the same as the driving-roller-width. Both edge portions of the plate portion 69A have circular-arc shapes or arcuate shapes. Tips of the ribs 69B, 69C and 69D have circular-arc shapes or arcuate shapes.

The belt guide 69 is fixed to the supporting portion 66 in such an orientation that a surface of the belt guide 69 faces frontward. More specifically, a back surface of the belt guide 69 is fixed to the front edge portion 66A of the supporting portion 66. The guide-widthwise direction is parallel to the unit-widthwise direction (i.e., the printer-crosswise direction). The temperature sensor 70 is provided, for example, between the adjacent ribs 69B and 69C on the surface of the belt guide 69. The temperature sensor 70 has a temperature detection surface protruding frontward from tips of the ribs 69B and 69C. When the fixing unit 16 is mounted to the color printer 1, the temperature sensor 70 is electrically connected to the above described control unit.

Figure 3:
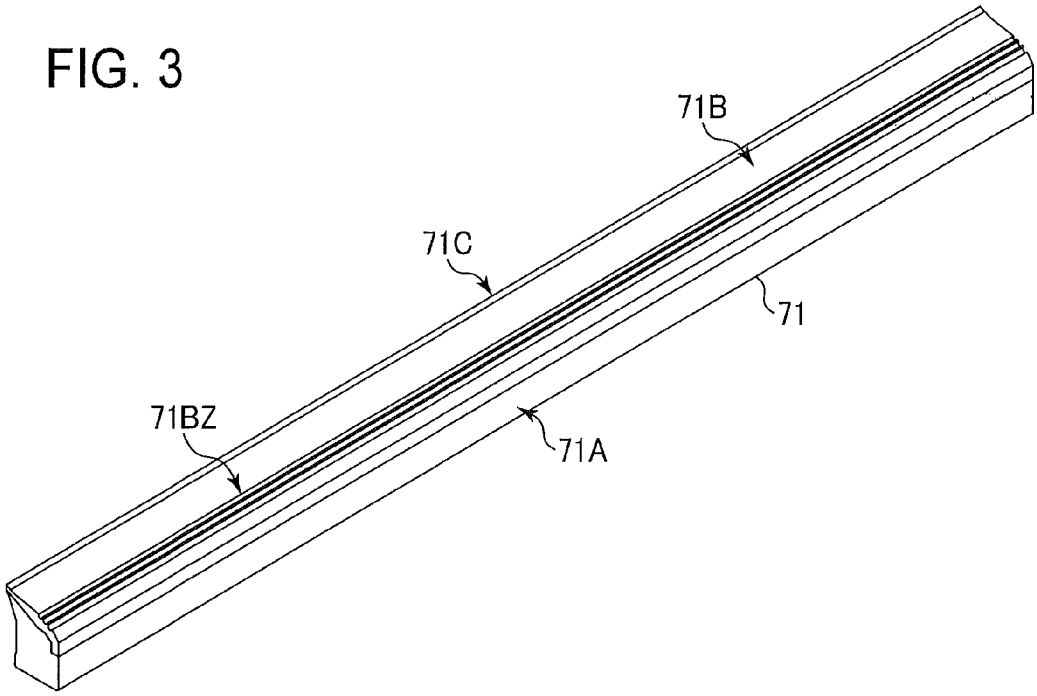
FIG. 3 is a perspective view showing a configuration of a pressing portion according to the first embodiment.
Figure 4:
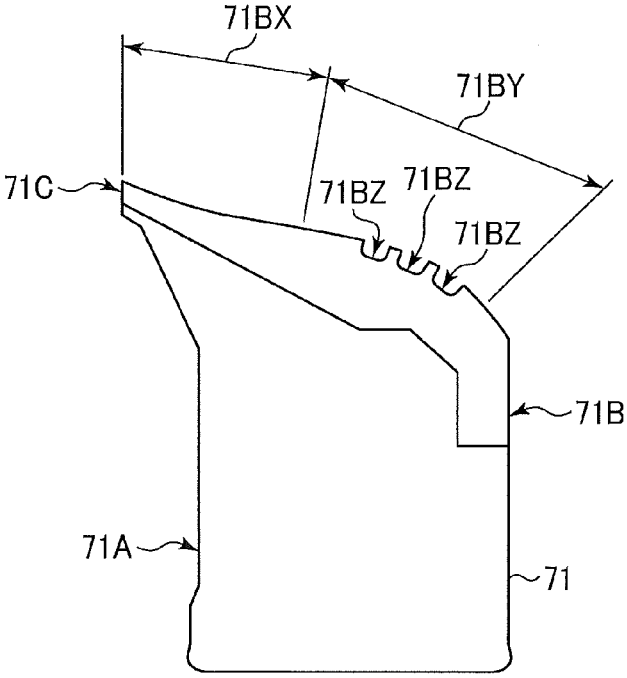
FIG. 4 is a side view showing the configuration of the pressing portion according to the first embodiment.

As shown in FIGS. 2, 3 and 4, the pressing portion 71 includes a pressing portion main body 71A elongated in the unit-widthwise direction and having a substantially J-shaped cross section. The pressing portion main body 71A is formed of, for example, metal or resin. A part of the pressing portion main body 71A is covered with a resilient layer 71B formed of rubber or the like. The resilient layer 71B has a substantially J-shaped cross section. An outer surface of the resilient layer 71B is inclined with respect to a surface 71D (i.e., an upper surface) of the pressing portion main body 71A opposite to the surface on which the resilient layer 71B is provided. The pressing portion 71 has a protruding portion 71C on the resilient layer 71B side. The protruding portion 71C has a tapered shape, and protrudes obliquely upward.

A longitudinal direction of the pressing portion 71, which is parallel to the unit-widthwise direction, is referred to as a pressing-portion-widthwise direction. The outer surface of the resilient layer 71B is referred to as a surface of the pressing portion 71. The surface 71D of the pressing portion main body 71A (opposite to the surface on which the resilient layer 71B is provided) is referred to as a back surface 71D of the pressing portion 71.

A width (referred to as a pressing-portion-width) between both ends of the pressing portion 71 in the pressing-portion-widthwise direction is, for example, substantially the same as the driving-roller-width. As shown in FIG. 4, a first region 71BX and a second region 71BY (i.e., a groove-formed portion) are provided on the surface of the pressing portion 71. The first region 71BX is located on the protruding portion 71C side, and the second region 71BY is located on the other side. The first region 71BX is formed to be curved in a circular-arc shape along an outer circumferential surface of the pressure roller 75. The second region 71BY is formed to be curved in a substantially circular-arc shape or a substantially arcuate shape so that the second region 71BY gradually approaches the back surface 71D of the pressing portion 71 along the frontward direction. An entire surface of the pressing portion 71 is coated with resin. That is, a resin coating layer is formed on the entire surface of the pressing portion 71. Therefore, the pressing portion 71 has an entirely smooth surface. The second region 71BY and the belt driving roller 65 constitute a nip-forming portion.

Further, the pressing portion 71 has, for example, engaging projections (not shown). The engaging projections are formed on both end surfaces of the pressing portion 71 in the longitudinal direction (i.e., the unit-widthwise direction). Engaging grooves are formed on the left and right inner surfaces of the left and right side plates 50C of the unit casing 50 so as to face each other. The engaging grooves are located on the front side of the belt driving roller 65. Each of the engaging grooves extends obliquely upward and frontward, and has a predetermined length.

The engaging projections of the pressing portion 71 are inserted into the engaging grooves of the left and right inner surfaces of the side plates 50C. The pressing-portion-widthwise direction is parallel to the unit-widthwise direction (i.e., the printer-crosswise direction). The pressing portion 71 is oriented so that the protruding portion 71C is directed rearward, and the back surface 71D faces obliquely upward and frontward. Therefore, the pressing portion 71 is movably supported by the unit casing 50 via the engaging grooves of the left and right side plates 50C. The pressing portion 71 is movable obliquely in an upward-frontward direction and a downward-rearward direction. While the pressing portion 71 moves, the orientation of the pressing portion 71 such that the second region 71BY is lower than the first region 71BX is maintained.

The heating section 60 includes a plurality of compression coil springs 83 (referred to as pressing coil springs) provided for biasing the pressing portion 71 obliquely downward and rearward. One ends of the compression coil springs 83 engage the back surface 71D of the pressing portion 71. The compression coil springs 83 are arranged at equal intervals in the unit-widthwise direction. The other ends of the compression coil springs 83 (opposite to those engaging the pressing portion 71) engage a lower surface of the center portion 66C of the supporting portion 66.

The heating-and-pressing belt 72 includes an endless belt main body having a predetermined thickness, a resilient layer formed on the main body, and a releasing layer formed on the resilient layer. In other words, the heating-and-pressing belt 72 has a three layer structure. The resilient layer has an entirely uniform thickness. Further, the releasing layer has an entirely uniform thickness. An inner surface (i.e., an inner circumferential surface) of the belt main body constitutes an inner surface 72A of the heating-and-pressing belt 72. An outer surface (i.e., an outer circumferential layer) of the releasing layer constitutes an outer surface 72B of the heating-and-pressing belt 72.

The belt main body is formed of resin such as polyimide. Therefore, the heating-and-pressing belt 72 has a flexibility, and also has a strength to a certain degree. The resilient layer is formed of resilient material such as rubber. Therefore, the heating-and-pressing belt 72 is deformable according to fine unevenness of the toner image 85 on the surface of the recording sheet 5, and can closely contact the surface of the recording sheet 5. The releasing layer is formed of a tube of resin such as PFA (tetra fluoro ethylene perfluoro alkyl vinyl ether copolymer). Therefore, releasability of the heating-and-pressing belt 72 from the surface of the recording sheet 5 and from the toner image 85 (on the surface of the recording sheet 5) is enhanced.

The heating-and-pressing belt 72 has both openings. A width (referred to as a belt-width) between the openings of the heating-and-pressing belt 72 is wider than the recording-sheet-width, but narrower than the pressing-portion-width (or the driving-roller-width). The heating-and-pressing belt 72 has a predetermined circumferential length. The heating-and-pressing belt 72 is stretched around the surface of the belt driving roller 65, the surface 67C of the heat transfer portion 67, the surface of the belt guide 69 (i.e., the edge portions of the plate portion 69A and the tips of the ribs 69B, 69C and 69D), and the second region 71BY of the surface of the pressing portion 71.

The number, spring coefficients, and positions (in the unit-widthwise direction) of the biasing coil springs 82 are suitably determined. The biasing coil springs 82 bias the heat transfer portion 67 so that the heat transfer portion 67 rotates in the second rotating direction d2 . Therefore, the surface 67*c* of the heat transfer portion 67 is pressed against an upper part of the inner surface 72A of the heating-and-pressing belt 72 with a uniform pressing force throughout the transfer-portion-width. Therefore, the heat transfer portion 67 applies a tension to the heating-and-pressing belt 72 so as to bias the upper part of the heating-and-pressing belt 72 to shift downward.

The number, spring coefficients, and positions (in the unit-widthwise direction) of the pressing coil springs 83 are suitably determined. The pressing coil springs 83 bias the pressing portion 71 so that the pressing portion 71 deforms and shifts obliquely downward and rearward. Therefore, the second region 71BY of the surface of the pressing portion 71 is pressed against a lower part of the inner surface 72A of the heating-and-pressing belt 72 with a uniform pressing force in the pressing-portion-widthwise direction. Therefore, the pressing portion 71 applies a tension to the heating-and-pressing belt 72 so as to bias the lower part of the heating-and-pressing belt 72 to shift upward.

Since the tension is applied in directions to cause the upper part and the lower part of heating-and-pressing belt 72 to respectively shift upward and downward, a rear part of the heating-and-pressing belt 72 is going to shift frontward, and a front part of the heating-and-pressing belt 72 is going to shift rearward. However, a rear lower part of the belt driving roller 65 contacts a rear lower part of the inner surface 72A of the heating-and-pressing belt 72. Therefore, the rear part of the heating-and-pressing belt 72 is prevented from shifting frontward.

Further, the surface (i.e., the edge portions of the plate portion 69A and the tips of the ribs 69B, 69C and 69D) of the belt guide 69 contacts the front part of the heating-and-pressing belt 72. Therefore, the front part of the heating-and-pressing belt 72 is prevented from shifting rearward. This arrangement prevents slackening of the heating-and-pressing belt 72 stretched around the surface of the belt driving roller 65, the surface 67C of the heat transfer portion 67, the surface of the belt guide 69 (i.e., the edge portions of the plate portion 69A and the tips of the ribs 69B, 69C and 69D), and the second region 71BY of the surface of the pressing portion 71.

The belt driving roller 65 has the resilient layer 65B that contacts the inner surface 72A of the heating-and-pressing belt 72 and generates a frictional force. With the frictional force, the surface of the belt driving roller 65 is kept in contact with the inner surface 72A of the heating-and-pressing belt 72. Therefore, when the belt driving roller 65 is driven by the fixing-unit-driving motor to rotate in the first rotating direction d1 in the printing operation, the heating-and-pressing belt 72 rotates in the first rotating direction d1 without causing slippage between the inner surface 72A of the heating-and-pressing belt 72 and the surface of the belt driving roller 65.

In the printing operation, the heater 68 is applied with a predetermined voltage by the heater-power source, and generates heat. The heat generated by the heater 68 is transmitted to the heating-and-pressing belt 72 via the heat transfer portion 67. Therefore, the heating-and-pressing belt 72 is heated while rotating in the first rotating direction d1.

The temperature detection surface of the temperature sensor 70 protrudes frontward from the tips of the ribs 69B and 69C of the belt guide 69, and is pressed against the inner surface 72A of the heating-and-pressing belt 72. In the printing operation, the control unit detects the temperature of the heating-and-pressing belt 72 (via the temperature sensor 70) rotating in the first rotating direction d1 while being heated. Based on the detected temperature, the control unit performs ON/OFF control of the heater-power source so as to maintain the temperature of the heating-and-pressing belt 72 to a predetermined temperature for heating the recording sheet 5.

The pressure roller 75 of the pressure section 61 includes, for example, a metal core 75A and a resilient layer 75B formed on the metal core 75A. The metal core 75A has a cylindrical shape with both end surfaces being closed, and has a larger outer diameter than an outer diameter of the belt driving roller 65. The resilient layer 75B is entirely formed on an outer circumferential surface of the metal core 75A. The resilient layer 75B is formed of sponge or rubber, and has a uniform thickness. The outer diameter of the pressure roller 75 is substantially uniform between both end surfaces of the pressure roller 75. A width (referred to as a pressure-roller-width) between both end surfaces of the pressure roller 75 is substantially the same as the driving-roller-width. A direction from the end surface to the other end surface (and an opposite direction thereto) is referred to as a pressure-roller-widthwise direction. For example, a pair of pressure roller rotation shafts (not shown) are provided on both end surfaces of the pressure roller 75. The pressure roller rotation shafts are coaxial with a center axis of the pressure roller 75.

The pressure section 61 further includes a pressure roller supporting portion (not shown) having a rectangular U-shape. A pair of rotary bearings (referred to as pressure roller rotary bearings) are provided on both shoulder portions of the pressure roller supporting portion. The pressure roller supporting portion is mounted to the left and right side plates 50C of the unit casing 50, and is located downward and frontward of the belt driving roller 65. A longitudinal direction of the pressure roller supporting portion is parallel to the unit-widthwise direction. The pressure roller supporting portion is shiftable in the unit-vertical direction (i.e., the printer-vertical direction) via the shoulder portions.

The pressure roller rotation shafts of the pressure roller 75 are mounted to the pressure roller rotary bearings of the pressure roller supporting portion. The pressure-roller-widthwise direction is parallel to the unit-widthwise direction (i.e., the printer-crosswise direction). Therefore, the pressure roller 75 is supported by the unit casing 50 via the pressure roller supporting portion so as to be rotatable in the second rotating direction d2 about the pressure roller rotation shafts parallel to the unit-widthwise direction. Further, the pressure roller 75 is shiftable in the unit-vertical direction (i.e., the printer-vertical direction) in such a manner that the pressure roller rotation shafts are kept parallel to the unit-widthwise direction.

For example, biasing portions such as tension springs are provided on the left and right side plates 50C of the unit casing 50. The biasing portions bias the pressure roller 75 in the unit-upward direction (i.e., the printer-upward direction) via the pressure roller rotation shafts. Due to biasing force of the biasing portions, an upper part of the surface of the pressure roller 75 is pressed against the surface of the belt driving roller 65 and the first region 71BX of the surface of the pressing portion 71 via a lower part of the heating-and-pressing belt 72 with a predetermined pressing force.

Further, a pressure roller link mechanism (not shown) is provided on, for example, one of the side plates 50C (i.e., the right side plate 50C) of the unit casing 50. The pressure roller link mechanism is configured to link one of the pressure roller rotation shafts (for example, the right pressure roller rotation shaft) to the rotation transmission mechanism provided in the printer casing 2. When the fixing unit 16 is mounted to the color printer 1, the pressure roller rotation shaft of the pressure roller 75 is linked with the rotation transmission mechanism via the pressure roller link mechanism. When the belt driving roller 65 and the heating-and-pressing belt 72 are driven by the fixing-unit-driving motor to rotate in the first rotating direction d1 in the printing operation, the pressure roller 75 rotates in the second rotation direction d2 in such a manner that the pressure roller 75 is pressed against a lower part of the outer surface 72B of the heating-and-pressing belt 72.

In this way, a nip portion 86 is formed by the upper part of the surface of the pressure roller 75, and the outer surface 72B of the heating-and-pressing belt 72 (ranging from the lower part of the belt driving roller 65 to the first region 71BX of the surface of the pressing portion 71). The recording sheet 5 is transported by the nip portion 86, and is heated and pressed in the nip portion 86.

In a particular example, the heat transfer portion 67 (having the transfer-portion-width which is substantially the same as the driving-roller-width) has both end surfaces which are respectively aligned with both end surfaces of the belt driving roller 65. Further, the belt guide 69 (having the guide-width which is substantially the same as the driving-roller-width) has both end surfaces which are respectively aligned with the belt driving roller 65.

Moreover, in a particular example, the pressing portion 71 (having the pressing-portion-width which is substantially the same as the driving-roller-width) has both end surfaces which are respectively aligned with both end surfaces of the belt driving roller 65. Further, the pressure roller 75 (having the pressure-roller-width which is substantially the same as the driving-roller-width) has both end surfaces which are respectively aligned with both end surfaces of the belt driving roller 65.

Figure 5:
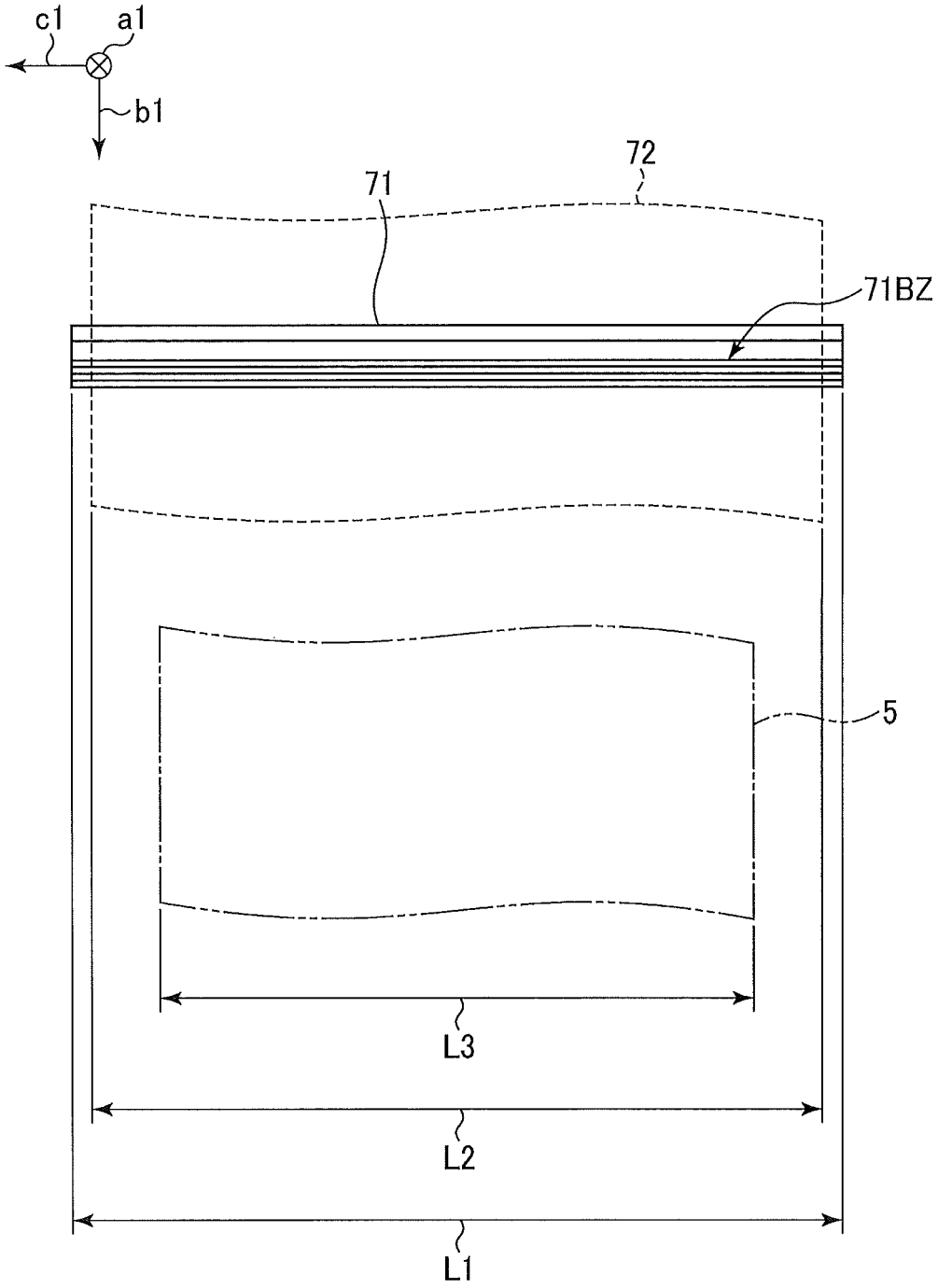
FIG. 5 is a schematic bottom view showing a positional relationship among the pressing portion, a heating-and-pressing belt and a recording sheet.

As shown in FIG. 5, the heating section 60 is so configured that the belt-width L2 is narrower than the pressing-portion-width L1. Therefore, the heating-and-pressing belt 72 is located at a center portion on the surface of the pressing portion 71 in the pressing-portion-widthwise direction. In other words, both ends portions of the pressing portion 71 protrude from both openings of the heating-and-pressing belt 72 in the belt-widthwise direction.

Similarly, the heating-and-pressing belt 72 is located at a center portion of the belt driving roller 65 in the driving-roller-widthwise direction. In other words, both ends portions of the belt driving roller 65 protrude from both openings of the heating-and-pressing belt 72 in the driving-roller-widthwise direction. The heating-and-pressing belt 72 is located at a center portion of the heat transfer portion 67 in the transfer-portion-widthwise direction. In other words, both ends portions of the heat transfer portion 67 protrude from both openings of the heating-and-pressing belt 72 in the in the belt-widthwise direction. The heating-and-pressing belt 72 is located at a center portion of the belt guide 69 in the guide-widthwise direction. In other words, both ends portions of belt guide 69 protrude from both openings of the heating-and-pressing belt 72 in the belt-widthwise direction.

Furthermore, the recording-sheet-width L3 is narrower than the belt-width L2 as shown in FIG. 5. Therefore, the heating section 60 and the pressure section 61 are arranged so that the recording sheet 5 is nipped at a center portion of the nip portion 86 (i.e., between the center portion of the heating-and-pressing belt 72 in the belt-widthwise direction and the center portion of the pressure roller 75 in the pressure-roller-widthwise direction).

The biasing coil springs 82 for biasing the heat transfer portion 67 to rotate in the second rotating direction d2 are provided between the supporting portion 66 and the pressure plate 81. Therefore, the heater 68 is biased by the biasing coil springs 82 against a bottom surface of the heater arrangement groove 67DX of the heat transfer portion 67 via the pressure plate 81. Therefore, the heater 68 closely contacts the bottom surface of the heater arrangement groove 67DX.

The heat transfer portion 67 is formed of metal having relatively high thermal conductivity as described above. A dimension of the surface 67C of the heat transfer portion 67 in a direction form upstream to downstream in the rotating direction of the heating-and-pressing belt 72 is relatively wide. A thickness from the surface 67C to the bottom surface of the heater arrangement groove 67DX is thin. Therefore, when the heater 68 generates heat, a temperature of an entire surface of the heat transfer portion 67 rises in a relatively short time. That is, the heating-and-pressing belt 72 can be effectively heated via the entire surface of the heat transfer portion 67 having the relatively wide width.

The belt guide 69 is formed of resin having relatively low thermal conductivity as described above. The belt guide 69 contacts the inner surface 72A of the heating-and-pressing belt 72 at both edge portions of the plate portion 69A and the tips of the ribs 69B, 69C and 69D. Therefore, a contact area between the belt guide 69 and the inner surface 72A of the heating-and-pressing belt 72 is minimized. Accordingly, although the belt guide 69 is located downstream of the heat transfer portion 67 in the rotating direction of the heating-and-pressing belt 72, quantity of heat absorbed by the belt guide 69 from the heating-and-pressing belt 72 can be minimized.

Further, since the nip portion 86 is formed by the outer surface 72B of the heating-and-pressing belt 72 and the surface of the pressure roller 75, the first region 71BX and the second region 71BY of the surface of the pressing portion 71 are pressed against the inner surface 72A of the heating-and-pressing belt 72. A dimension of the first region 71BX and the second region 71BY (in a direction from upstream to downstream in the rotating direction of the heating-and-pressing belt 72) pressed against the inner surface 72A of the heating-and-pressing belt 72 is relatively narrow. Therefore, although the pressing portion 71 is located downstream of the heat transfer portion 67 in the rotating direction of the heating-and-pressing belt 72, quantity of heat absorbed by the pressing portion 71 from the heating-and-pressing belt 72 can be minimized.

Accordingly, when the heating-and-pressing belt 72 rotates in the first rotating direction d1 in the printing operation, it is possible to suppress decrease in temperature of a heated portion of the heating-and-pressing belt 72 heated by the heater 68 (via the heat transfer portion 67) before the heated portion reaches the nip portion 86. As a result, the recording sheet 5 can be reliably heated at a predetermined temperature.

The separating portion 62 is formed of, for example, a metal plate or a resin plate. The separating portion 62 is elongated in the unit-widthwise direction, and has a substantially L-shaped cross section. A tip of the separating portion 62 is substantially wedge shaped. A longitudinal direction of the separating portion 62, which is parallel to the unit-widthwise direction, is referred to as a separating-portion-widthwise direction. A width (referred to as a separating-portion-width) between both end surfaces of the separating portion 62 is substantially the same as the casing-inner-width.

Both end surfaces of the separating portion 62 are fixed to the left and right inner surfaces of the left and right side plates 50C of the unit casing 50. The separating-portion-widthwise direction is parallel to the unit-widthwise direction (i.e., the printer crosswise direction). The tip of the separating portion 62 is located at a rear side of the nip portion 86, and is in the vicinity of the outer surface 72B of the heating-and-pressing belt 72. Therefore, the separating portion 62 prevents the recording sheet 5 (having passed the nip portion 86) from sticking to the outer surface 72B of the heating-and-pressing belt 72. That is, the recording sheet 5 can be reliably transported to the recording sheet exit opening of the unit casing 50.

When the color printer 1 performs the printing operation, the control unit causes the heater 68 of the fixing unit 16 to generate heat by applying a predetermined voltage to the heater from the heater-power source. Further, the control unit drives the fixing-unit-driving motor to cause the belt driving roller 65 and the heating-and-pressing belt 72 to rotate in the first rotating direction d1 and to cause the pressure roller 75 to rotate in the second rotating direction d2 while the pressure roller 75 is pressed against the outer surface 72B of the heating-and-pressing belt 72. Furthermore, the control unit detects the temperature of the heating-and-pressing belt 72 via the temperature sensor 70, and performs ON/OFF control of the heater 68 so as to heat the heating-and-pressing belt 72 to a fixing temperature for heating the recording sheet 5.

In this way, when the temperature of the heating-and-pressing belt 72 reaches the predetermined temperature, the control unit performs processing to feed the recording sheet 5 from the feeding tray 52, transport the recording sheet 5 through the image forming units 10, 11, 12 and 13 and the transfer unit 15, and to transfer toner images of four colors to the recording sheet 5 in an overlapping manner. Therefore, a color toner image 85 is transferred to the recording sheet 5.

The recording sheet 5 (to which the color toner image has been transferred) is then transported to the fixing unit 16 through the recording sheet entry opening of the unit casing 50. The recording sheet 5 passes through the nip portion 86 between the outer surface 72B of the heating-and-pressing belt 72 and the surface of the pressure roller 75 that rotate in mutually opposite directions. The recording sheet 5 is heated and pressed in the nip portion 86, and the toner image 85 is fixed to the recording sheet 5. The recording sheet 5 is then ejected from the fixing unit 16 through the recording sheet exit opening, and is transported into the ejection transport path. In this way, the color toner image 85 is fixed to the recording sheet 5. The recording sheet 5 is then ejected from the color printer 1 through the sheet ejection opening 2BY.

In the printing operation, the heating-and-pressing belt 72 is driven to rotate by the belt driving roller 65 in the first rotating direction d1 as described above. The inner surface 72A of the heating-and-pressing belt 72 slides on the surface 67C of the heat transfer portion 67 in such a manner that the surface 67C of the heat transfer portion 67 is pressed against the inner surface 72A of the heating-and-pressing belt 72 with a predetermined pressing force. Further, the inner surface 72A of the heating-and-pressing belt 72 slides on the surface of the belt guide 69 in such a manner that the surface of the belt guide 69 (i.e., the edge portions of the plate portion 69A and the tips of the ribs 69B, 69C and 69D) is pressed against the inner surface 72A of the heating-and-pressing belt 72 with a predetermined pressing force. Further, the inner surface 72A of the heating-and-pressing belt 72 slides on the surface of the pressing portion 71 in such a manner that the surface of the pressing portion 71 is pressed against the inner surface 72A of the heating-and-pressing belt 72 with a predetermined pressing force. Accordingly, when the heating-and-pressing belt 72 is driven to rotate by the belt driving roller 65 in the first rotating direction d1 , the heating-and-pressing belt 72 is not slackened.

While the heating-and-pressing belt 72 rotates in the first rotating direction d1 , slippage of the inner surface 72A of the heating-and-pressing belt 72 on the surface of the belt driving roller 65 hardly occurs. Therefore, the inner surface 72A of the heating-and-pressing belt 72 is hardly worn by the rotation of the heating-and-pressing belt 72. Accordingly, wear debris is not generated by contact between the inner surface 72A and the belt driving roller 65 when the heating-and-pressing belt 72 rotates in the first rotating direction d1.

Further, the entire surface of the pressing portion 71 is made smooth by resin coating. Therefore, when the heating-and-pressing belt 72 rotates in the first rotating direction d1 , the surface of the pressing portion 71 closely contacts the inner surface 72A of the heating-and-pressing belt 72. Accordingly, although the inner surface 72A of the heating-and-pressing belt 72 slides on the surface of the pressing portion 71 when the heating-and-pressing belt 72 rotates in the first rotating direction d1 , wear debris is not generated by sliding contact between the inner surface 72A and the pressing portion 71.

In contrast, the surface 67C of the heat transfer portion 67 has a fine unevenness (i.e., fine concaves and convexes) according to material of the heat transfer portion 67 or formation accuracy. Therefore, when the heating-and-pressing belt 72 rotates in the first rotating direction d1 , the surface 67C of the heat transfer portion 67 does not closely contact the inner surface 72A of the heating-and-pressing belt 72. Accordingly, when the inner surface 72A of the heating-and-pressing belt 72 slides on the surface 67C of the heat transfer portion 67, the inner surface 72A may be worn, and fine wear debris may be generated.

Similarly, the surface of the belt guide 69 has a fine unevenness according to material of the belt guide 69 or formation accuracy. Therefore, when the heating-and-pressing belt 72 rotates in the first rotating direction d1 , the surface (i.e., both edge portions of the plate portion 69A and the tips of the ribs 69B, 69C and 69D) of the belt guide 69 does not closely contact the inner surface 72A of the heating-and-pressing belt 72. Accordingly, when the inner surface 72A of the heating-and-pressing belt 72 slides on the surface of the belt guide 69, the inner surface 72A may be worn, and fine wear debris may be generated.

In this way, when the fixing unit 16 is continuously used for printing, the inner surface 72A may be gradually worn by sliding contact with the surface 67C of the heat transfer portion 67 and the surface of the belt guide 69, and the fine wear debris may be generated. Such fine wear debris may move toward the pressing portion 71 located downstream of the heat transfer portion 67 and the belt guide 69 in the rotating direction of the heating-and-pressing belt 72 according to the rotation of the heating-and-pressing belt 72 in the first rotating direction d1.

Therefore, in the fixing unit 16 of the first embodiment, a plurality of (for example, three) grooves 71BZ are provided on the second region 71BY of the surface of the pressing portion 71 (FIGS. 2, 3 and 4). The grooves 71BZ are provided for catching (i.e., receiving) the fine wear debris 90, and referred to as wear-debris-receiving grooves 71BZ. The wear-debris-receiving grooves 71BZ linearly extend in a direction parallel to the pressing-portion-widthwise direction between both end surfaces of the pressing portion 71 (i.e., extend from one end surface to the other end surface). The wear-debris-receiving grooves 71BZ are arranged at equal intervals in the rotating direction of the heating-and-pressing belt 72. That is, the pressing portion 71 has a plurality of wear-debris-receiving grooves 71BZ on the second region 71BY of the surface pressed against the inner surface 72A of the heating-and-pressing belt 72, and the wear-debris-receiving grooves 71BZ are arranged in the rotating direction of the heating-and-pressing belt 72. Each wear-debris-receiving groove 71BZ has a length in the unit-widthwise direction which is longer than or equal to a dimension at which the recording sheet 5 is nipped by the nip portion 86 in the unit-widthwise direction. In practice, the length of each wear-debris-receiving groove 71BZ is longer than or equal to the belt-width.

Depths and widths of the wear-debris-receiving groove 71BZ are suitably determined according to a size of the fine wear debris 90 generated by wear of the inner surface 72A of the heating-and-pressing belt 72. That is, depths and widths of the wear-debris-receiving groove 71BZ are suitably determined so that the wear-debris-receiving groove 71BZ can sufficiently catch the fine wear debris 90.

In this regard, the "width" of the wear-debris-receiving groove 71BZ is a dimension in a direction perpendicular to an extending direction of the wear-debris-receiving groove 71BZ.

In a particular example, each wear-debris-receiving groove 71BZ has a depth in a range from 0.5 mm to 1.0 mm, and a width in a range from 0.3 mm to 0.5 mm. The depth and width are uniform throughout the pressing-portion-width.

Figure 6:
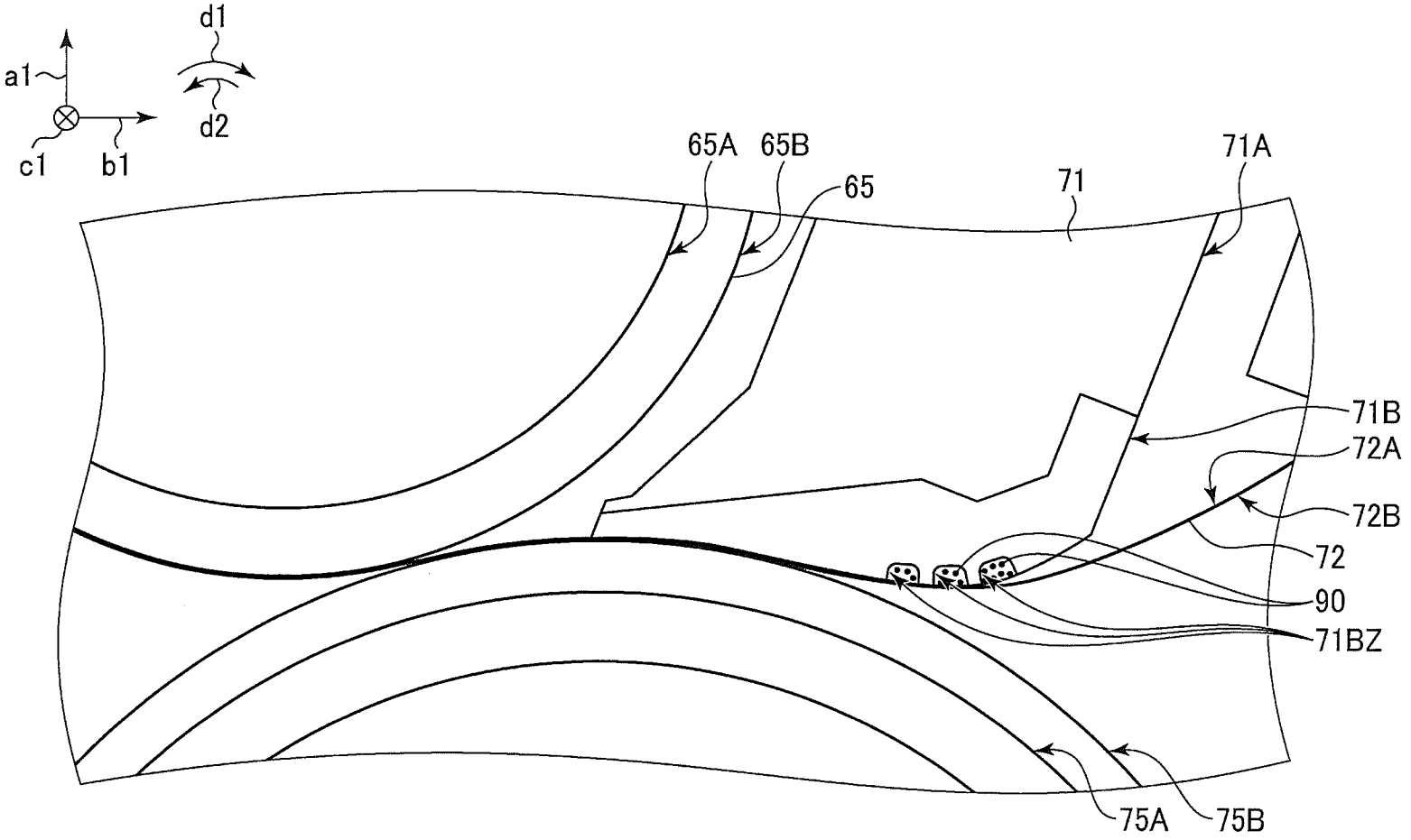
FIG. 6 is a schematic view showing a manner in which a wear debris is caught by wear-debris-receiving grooves of the pressing portion.

Therefore, as shown in FIG. 6, when the fine wear debris (shown by numeral 90) is generated by wear of the inner surface 72A of the heating-and-pressing belt 72 contacting the surface 67C of the heat transfer portion 67 and the surface of the belt guide 69 and reaches the vicinity of the pressing portion 71, the fine wear debris 90 is caught (i.e., received) in the wear-debris-receiving grooves 71BZ. Since the surface of the pressing portion 71 closely contacts the inner surface 72A of the heating-and-pressing belt 72, the fine wear debris 90 generated by wear of the inner surface 72A of the heating-and-pressing belt 72 reaches the second region 71BY of the surface of the pressing portion 71, the fine wear debris 90 can effectively caught by the wear-debris-receiving grooves 71BZ.

When the recording sheet 5 is nipped in the nip portion 86 between the outer surface 72B of the heating-and-pressing belt 72 and the surface of the pressure roller 75, there is a possibility that fine vibration of the heating-and-pressing belt 72 may be generated by unevenness of the toner image 85 on the surface of the recording sheet 5. However, a plurality of wear-debris-receiving grooves 71BZ are formed on the second region 71BY of the surface of the pressing portion 71, and are arranged from upstream to downstream along the rotating direction of the heating-and-pressing belt 72. Therefore, even if the fine wear debris 90 is not caught by the most upstream wear-debris-receiving groove 71BZ due to the vibration of the heating-and-pressing belt 72, the fine wear debris 90 is caught by the other (more downstream) wear-debris-receiving grooves 71BZ.

Further, edges of the wear-debris-receiving grooves 71BZ are not chamfered but are angulated. Therefore, even if the fine wear debris 90 adheres to the inner surface 72A of the heating-and-pressing belt 72 and reaches the second region 71BY, the fine wear debris 90 is scraped off from the inner surface 72A of the heating-and-pressing belt 72 by angulated edges of the wear-debris-receiving grooves 71BZ, and is caught by the wear-debris-receiving grooves 71BZ.

Moreover, in the pressing portion 71, the first region 71BX is provided for forming the nip portion 86 between the heating-and-pressing belt 72 and the pressure roller 75. The wear-debris-receiving grooves 71BZ are formed on the second region 71BY located upstream of the first region 71BX in the rotating direction of the heating-and-pressing belt 72. Therefore, the fine wear debris 90 is caught by the wear-debris-receiving grooves 71BZ just before the fine wear debris 90 reaches the first region 71BX. Thus, the fine wear debris 90 can be prevented from entering into between the first region 71BX of the surface of the pressing portion 71 and the inner surface 72A of the heating-and-pressing belt 72.

Accordingly, it becomes possible to prevent formation of fine unevenness on the outer surface 72B of the heating-and-pressing belt 72 at the nip portion 86 due to the existence of the fine wear debris 90 entering into between the first region 71BX of the surface of the pressing portion 71 and the inner surface 72A of the heating-and-pressing belt 72. As a result, when the recording sheet 5 is heated and pressed by the outer surface 72B of the heating-and-pressing belt 72 and the surface of the pressure roller 75 in the nip portion 86, occurrence of variation in heating and pressing of the recording sheet 5 can be prevented.

<Operation and Effects of First Embodiment>

As described above, in the fixing unit 16 of the color printer 1 of the first embodiment, the heating-and-pressing belt 72 is stretched around the surface of the belt driving roller 65, the surface 67C of the heat transfer portion 67, the surface of the belt guide 69, and the second region 71BY of the surface of the pressing portion 71.

Further, in the fixing unit 16 of the color printer 1, the surface of the pressure roller 75 is pressed against the surface of the belt driving roller 65 and the first region 71BX of the surface of the pressing portion 71 via the heating-and-pressing belt 72, so that the nip portion 86 is formed between the surface of the pressure roller 75 and the outer surface 72B of the heating-and-pressing belt 72.

In the printing operation, the belt driving roller 65 and the heating-and-pressing belt 72 rotate in the first rotating direction, and the pressure roller 75 rotates in the second rotating direction, while the surface 67C of the heat transfer portion 67, the surface of the belt guide 69 and the surface of the pressing portion 71 are pressed against the inner surface 72A of the heating-and-pressing belt 72 heated to the predetermined temperature.

In this state, the fixing unit 16 heats and presses the recording sheet 5 (with the transferred toner image 85) while nipping the recording sheet 5 in the nip portion 86 between the outer surface 72B of the heating-and-pressing belt 72 and the surface of the pressure roller 75. Therefore, the toner image 85 is fixed to the surface of the recording sheet 5.

When the belt driving roller 65 and the heating-and-pressing belt 72 rotate in the first rotating direction, the inner surface 72A of the heating-and-pressing belt 72 slides on the surface 67C of the heat transfer portion 67, the surface of the belt guide 69 and the surface of the pressing portion 71 in such a manner that the surface 67C of the heat transfer portion 67, the surface of the belt guide 69 and the surface of the pressing portion 71 are pressed against the inner surface 72A of the heating-and-pressing belt 72. Therefore, the heating-and-pressing belt 72 is prevented from slackening.

The wear-debris-receiving grooves 71BZ are formed on the second region 71BY of the surface of the pressing portion 71. The length of each wear-debris-receiving groove 71BZ in the unit-widthwise direction is longer than or equal to the dimension at which the recording sheet 5 is nipped by the nip portion 86.

With such a configuration, even if the fine wear debris 90 is generated by wear of the inner surface 72A of the heating-and-pressing belt 72 contacting the surface 67C of the heat transfer portion 67 and the surface of the belt guide 69, the fine wear debris 90 is caught by the wear-debris-receiving grooves 71BZ of the pressing portion 71. Therefore, the fine wear debris 90 is prevented from entering into between the first region 71BX of the surface of the pressing portion 71 and the inner surface 72A of the heating-and-pressing belt 72.

Accordingly, formation of fine unevenness on the outer surface 72B of the heating-and-pressing belt 72 in the nip portion 86 can prevented. That is, occurrence of variation in heating and pressing of the recording sheet 5 (by the outer surface 72B of the heating-and-pressing belt 72 and the surface of the pressure roller 75) can be prevented. As a result, fixing failure of the toner image 85 on the surface of the recording sheet 5 due to the variation in heating and pressing of the recording sheet 5 can be prevented. Thus, failure in forming the toner image on the recording sheet 5 (such as unevenness in glossiness) can be prevented. That is, image quality can be enhanced.

As described above, in the fixing unit 16 of the color printer 1 according to the first embodiment, the wear-debris-receiving grooves 71BZ are formed in the second region 71BY of the surface of the pressing portion 71. The heating-and-pressing belt 72 is stretched around the surface of the belt driving roller 65, the surface 67C of the heat transfer portion 67, the surface of the belt guide 69, and the second region 71BY of the surface of the pressing portion 71. In the printing operation, when the heating-and-pressing belt 72 is driven by the belt driving roller 65 to rotate in the first rotating direction d1 , the inner surface 72A of the heating-and-pressing belt 72 slides on the surface 67C of the heat transfer portion 67, the surface of the belt guide 69 and the surface of the pressing portion 71 while the surface 67C of the heat transfer portion 67, the surface of the belt guide 69 and the surface of the pressing portion 71 are pressed against the inner surface 72A of the heating-and-pressing belt 72.

Therefore, in the fixing unit 16 of the color printer 1, even if the fine wear debris 90 is generated in the printing operation, the fine wear debris 90 is caught by the wear-debris-receiving grooves 71BZ of the surface of the pressing portion 71. Therefore, formation of fine unevenness on the outer surface 72B of the heating-and-pressing belt 72 can prevented, with the result that occurrence of variation in heating and pressing of the recording sheet 5 can be prevented. As a result, failure in forming the toner image on the recording sheet 5 can be prevented, and image quality can be enhanced.

Further, since the surface of the pressing portion 71 is coated with resin, a close contact property of the surface of the pressing portion 71 with the inner surface 72A of the heating-and-pressing belt 72 can be enhanced.

Therefore, when the heating-and-pressing belt 72 rotates in the first rotating direction d1 while the surface of the pressing portion 71 is pressed against the inner surface 72A of the heating-and-pressing belt 72 (i.e., the inner surface 72A of the heating-and-pressing belt 72 slides on the surface of the pressing portion 71), wear of the inner surface 72A of the heating-and-pressing belt 72 can be minimized. That is, generation of the fine wear debris can be minimized. Moreover, since the surface of the pressing portion 71 closely contacts the inner surface 72A of the heating-and-pressing belt 72, the fine wear debris 90 (carried to the pressing portion 71 by the heating-and-pressing belt 72) can be reliably caught by the wear-debris-receiving grooves 71BZ.

In this regard, if the fine wear debris 90 enters into between the inner surface 72A of the heating-and-pressing belt 72 and the surface of the pressing portion 71, the fine wear debris becomes a resistance to a sliding movement of the inner surface 72A of the heating-and-pressing belt 72 with respect to the surface of the pressing portion 71. However, since the fine wear debris 90 is prevented from entering into between the inner surface 72A of the heating-and-pressing belt 72 and the surface of the pressing portion 71 as described above, the resistance to the sliding movement can be reduced.

Further, a plurality of wear-debris-receiving grooves 71BZ are formed on the second region 71BY of the surface of the pressing portion 71, and are arranged from upstream to downstream in the rotating direction of the heating-and-pressing belt 72. Therefore, even if the fine wear debris 90 is not caught by the most upstream wear-debris-receiving groove 71BZ, the fine wear debris 90 is caught by the other (more downstream) wear-debris-receiving grooves 71BZ.

Furthermore, the wear-debris-receiving grooves 71BZ formed on the second region 71BY of the surface of the pressing portion 71 have angulated edges. Therefore, even if the fine wear debris 90 adheres to the inner surface 72A of the heating-and-pressing belt 72 and reaches the second region 71BY, the fine wear debris 90 is scraped off from the inner surface 72A of the heating-and-pressing belt 72 by the angulated edges of the wear-debris-receiving grooves 71BZ, and is caught by the wear-debris-receiving grooves 71BZ. Accordingly, the fine wear debris 90 can be reliably caught by the wear-debris-receiving grooves 71BZ of the pressing portion 71.

Moreover, the pressing portion 71 is located in the vicinity of the belt driving roller 65 and is located downstream of the heat transfer portion 67 and the belt guide 69 in the rotating direction of the heating-and-pressing belt 72. The surface of the pressure roller 75 is pressed against the surface of the belt driving roller 65 and the first region 71BX of the surface of the pressing portion 71 via the heating-and-pressing belt 72 so as to form the nip portion 86. In the nip portion 86, the recording sheet 5 is nipped between the surface of the belt pressure roller 75 and the outer surface 72B of the heating-and-pressing belt 72, and is heated and pressed.

In addition, a plurality of wear-debris-receiving grooves 71BZ are formed on the second region 71BY which is located adjacent to and upstream of the first region 71BX of the surface of the pressing portion 71 in the rotating direction of the heating-and-pressing belt 72. Most of a region where the fine wear debris 90 is generated (by wear of the inner surface 72*a* of the heating-and-pressing belt 72) is located upstream of the pressing portion 71 in the rotating direction of the heating-and-pressing belt 72.

Most of the fine wear debris 90 generated by wear of the inner surface 72*a* of the heating-and-pressing belt 72 is carried to the pressing portion 71 by the rotation of the heating-and-pressing belt 72. Such fine wear debris 90 is caught by the wear-debris-receiving grooves 71BZ just before the fine wear debris 90 reaches the first region 71BX of the surface of the pressing portion 71. Therefore, the fine wear debris 90 can be reliably prevented from entering into between the first region 71BX of the surface of the pressing portion 71 and the inner surface 72A of the heating-and-pressing belt 72.

As a result, the formation of fine unevenness on the outer surface 72B of the heating-and-pressing belt 72 (due to existence of the fine wear debris 90) can be reliably prevented. Consequently, the fixing failure of the toner image on the surface of the recording sheet 5 can be prevented, and failure in forming the toner image (such as unevenness in glossiness) can be prevented. That is, image quality can be enhanced.

In this way, the fixing unit 16 of the color printer 1 prevents the failure in forming the toner image on the surface of the recording sheet 5 caused by the fine wear debris 90. Therefore, a lifetime of the fixing unit 16 can be lengthened. As a result, the number of replacement of the fixing unit 16 can be reduced, and user convenience is enhanced.

Second Embodiment

<Configuration of Printer>

A configuration of the color printer 100 (FIG. 1) according to the second embodiment of the present invention will be described. The color printer 100 of the second embodiment is the same as the color printer 1 of the first embodiment except for a part of the fixing unit 101 (FIG. 1).

The color printer 100 is configured to form a toner image (i.e., a developer image) on the recording sheet 5 in a similar manner to the color printer 1 of the first embodiment. Therefore, explanation of the configuration of the color printer 100 of the second embodiment is omitted.

<Configuration of Fixing Unit>

Figure 7:
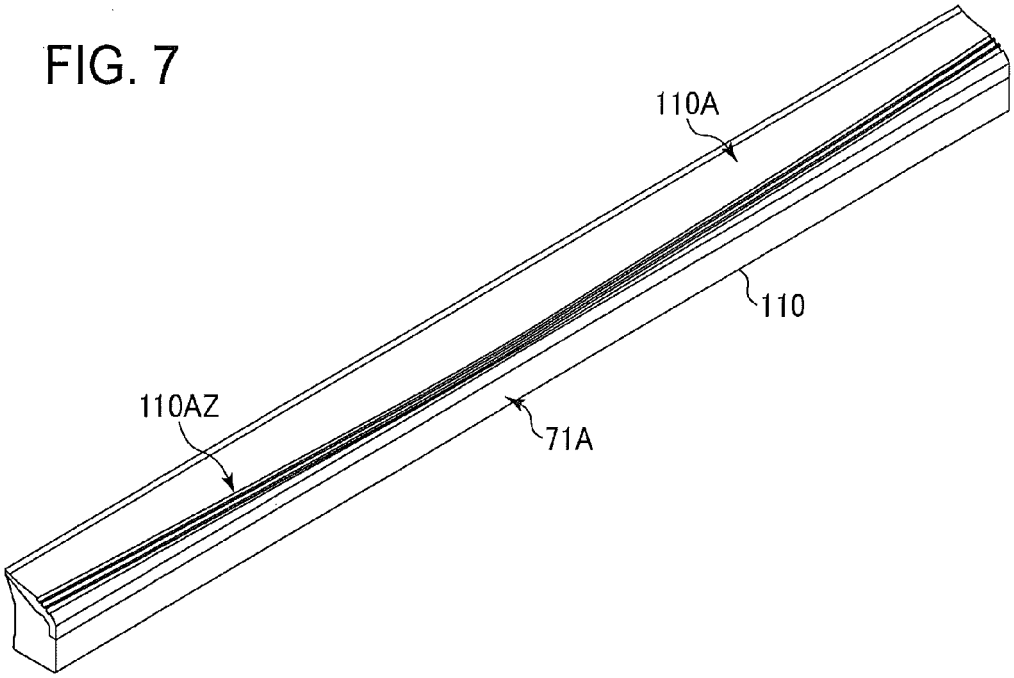
FIG. 7 is a perspective view showing a configuration of a pressing portion according to the second embodiment.
Figure 8:
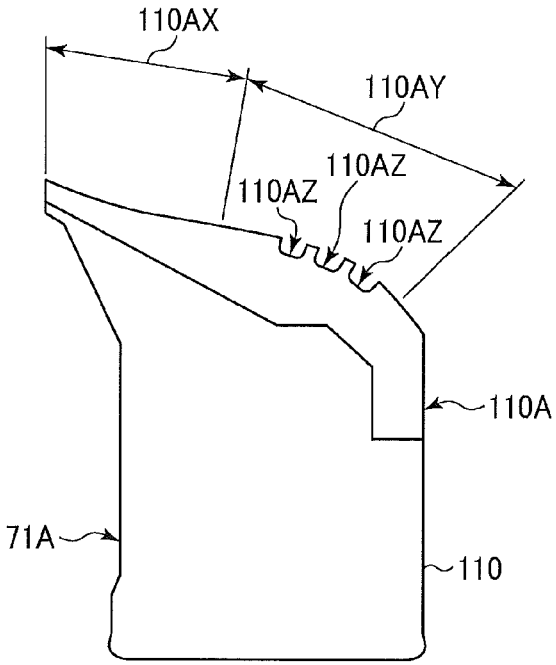
FIG. 8 is a side view showing the configuration of a pressing portion according to the second embodiment.
Figure 9:
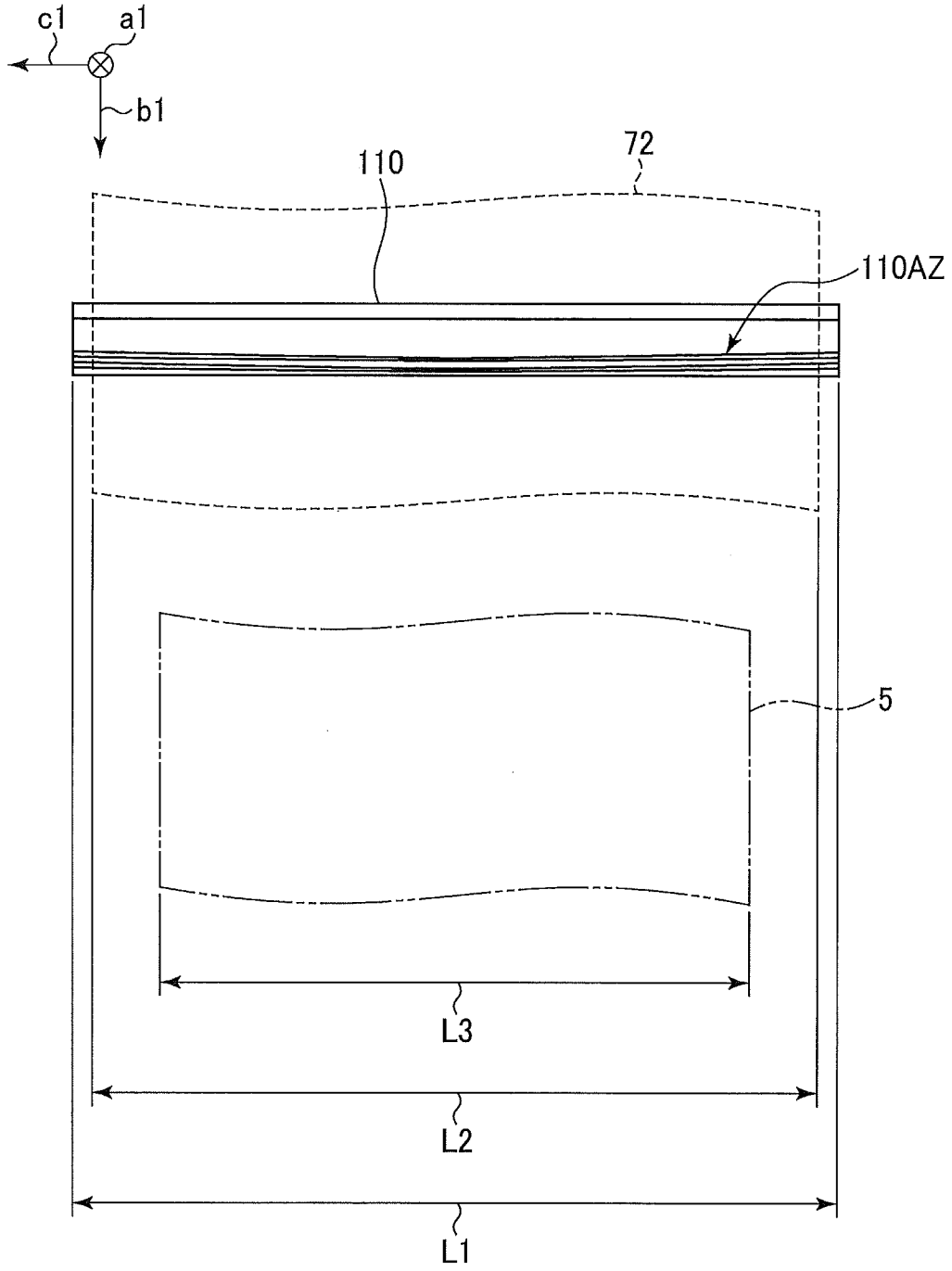
FIG. 9 is a schematic bottom view showing a positional relationship among a pressing portion, a heating-and-pressing belt and a recording sheet.
Figure 10:
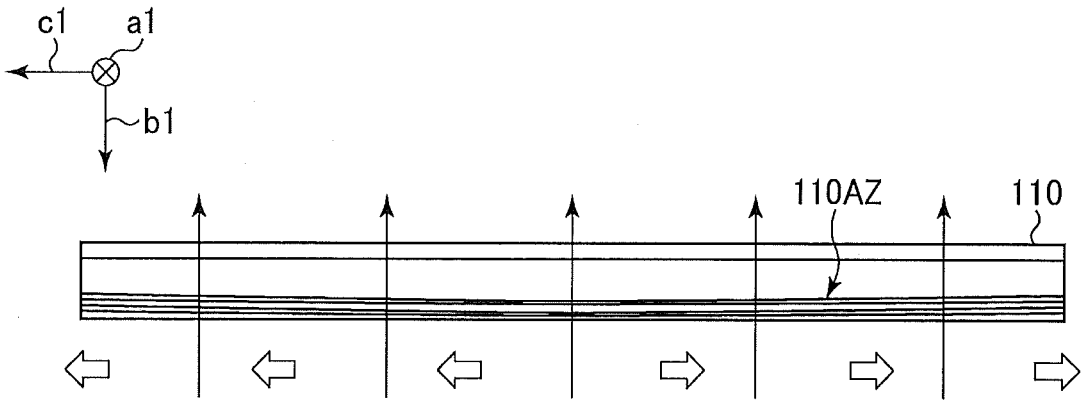
FIG. 10 is a schematic view showing a manner in which wear debris is ejected out of wear-debris-receiving grooves of the pressing portion.

A configuration of the fixing unit 101 according to the second embodiment will be described. The fixing unit 101 of the second embodiment is the same as the fixing unit 16 of the first embodiment except for a pressing portion 110 (FIG. 2) of a heating section 105 (FIG. 2). Hereinafter, a configuration of the pressing portion 110 will be described with reference to FIGS. 7 through 9. In FIGS. 7 through 9, components of the fixing unit 101 corresponding to those of the fixing unit 16 of the first embodiment (FIGS. 3 through 5) are assigned with the same reference numerals.

As shown in FIGS. 7 through 9, the pressing portion 110 includes a pressing portion main body 71A and a resilient layer 110A provided on a surface of the pressing portion main body 71A. The resilient layer 110A is formed of the same material as the resilient layer 71B of the first embodiment, and has the same shape and same size as the resilient layer 71B of the first embodiment. A resin coating layer is formed on the entire surface of the pressing portion 110 in a similar manner to the pressing portion 71 of the first embodiment. That is, the pressing portion 110 has an entirely smooth surface. In this way, the pressing portion 110 has the same outer shape as the pressing portion 71 of the first embodiment.

The pressing portion 110 is supported by the unit casing 50 in such a manner that the pressing portion 110 is movable obliquely in an upward-frontward direction and a downward-rearward direction in a similar manner to the pressing portion 71 of the first embodiment. In a state where the heating-and-pressing belt 72 is located at the center portion of the surface of the pressing portion 110 in the pressing-portion-widthwise direction, the surface of the pressing portion 110 is pressed against the inner surface 72A of the heating-and-pressing belt 72. Both ends of the pressing portion 110 protrude from both openings of the heating-and-pressing belt 72 in the belt-widthwise direction in a similar manner to the pressing portion 71 of the first embodiment.

Further, a plurality of (for example, three) wear-debris-receiving grooves 110AZ are formed on the second region 110AY of the surface of the pressing portion 110, and extend between both end surfaces of the pressing portion 110. The wear-debris-receiving grooves 110AZ extend in a V-shape so that both end portions of each wear-debris-receiving groove 110AZ are located downstream of a center portion of each wear-debris-receiving groove 110AZ in the rotating direction of the heating-and-pressing belt 72. Further, the wear-debris-receiving grooves 110AZ are arranged at equal intervals in the rotating direction of the heating-and-pressing belt 72.

Each wear-debris-receiving groove 110AZ has a length in the unit-widthwise direction which is longer than or equal to a dimension at which the recording sheet 5 is nipped by the nip portion 86. In practice, the length of each wear-debris-receiving groove 110AZ is longer than or equal to the belt-width. That is, the pressing portion 110 has the wear-debris-receiving grooves 110AZ formed on the second region 110AY and extending in the V-shape so that the center portion of each wear-debris-receiving groove 110AZ is located upstream in the rotating direction of the heating-and-pressing belt 72, and both end portions of each wear-debris-receiving groove 110AZ are located downstream in the rotating direction of the heating-and-pressing belt 72. The center portion of each wear-debris-receiving groove 110AZ is referred to as a groove center portion. Both end portions (i.e., one end portion and the other end portion) of each wear-debris-receiving groove 110AZ are referred to as groove end portions (i.e., one groove end portion and the other groove end portion).

Depths and widths of the wear-debris-receiving grooves 110AZ are determined according to a size of the fine wear debris 90 generated by wear of the inner surface 72A of the heating-and-pressing belt 72 as with the wear-debris-receiving grooves 71BZ of the first embodiment. In a particular example, each wear-debris-receiving groove 110AZ has a depth in a range from 0.5 mm to 1.0 mm, and a width in a range from 0.3 mm to 0.5 mm. The depth and width are uniform throughout the pressing-portion-width.

Further, edges of the wear-debris-receiving grooves 110AZ are not chamfered, but are angulated as with the as with the wear-debris-receiving grooves 71BZ of the first embodiment. Therefore, in the printing operation, the fine wear debris 90 (generated by wear of the inner surface 72A of the heating-and-pressing belt 72 contacting the surface 67C of the heat transfer portion 67 and the surface of the belt guide 69) is scraped off from the inner surface 72A of the heating-and-pressing belt 72 by the angulated edges of the wear-debris-receiving grooves 110AZ, and is caught by the wear-debris-receiving grooves 110AZ.

In the fixing unit 101, when the heating-and-pressing belt 72 is driven to rotate in the first rotating direction by the belt driving roller 65, airflow is generated in a direction from upstream to downstream in the rotating direction of the heating-and-pressing belt 72. Therefore, when the heating-and-pressing belt 72 rotates in the first rotating direction d1 in a state where the fine wear debris 90 is caught by the wear-debris-receiving grooves 110AZ, the fine wear debris 90 gradually moves along the wear-debris-receiving grooves 110AZ from the groove center portion toward both groove end portions by action of the airflow.

As the heating-and-pressing belt 72 continuously rotates in the first rotating direction d1 , the fine wear debris 90 caught by the wear-debris-receiving grooves 110AZ can be ejected outside via both groove end portions. Therefore, even if the fixing unit 101 is used for a long time, the fine wear debris 90 can be prevented from overflowing from the wear-debris-receiving grooves 110AZ.

<Operation and Effects of Second Embodiment>

As described above, the wear-debris-receiving grooves 110AZ are formed on the second region 110AY of the surface of the pressing portion 110. The wear-debris-receiving grooves 110AZ has the length in the unit-widthwise direction which is longer than or equal to a dimension at which the recording sheet 5 is nipped by the nip portion 86. The wear-debris-receiving grooves 110AZ extend in the V-shape so that the center portion of each wear-debris-receiving groove 110AZ is located upstream in the rotating direction of the heating-and-pressing belt 72, and both end portions of each wear-debris-receiving groove 110AZ are located downstream in the rotating direction of the heating-and-pressing belt 72.

With such a configuration, even if the fine wear debris 90 is generated by wear of the inner surface 72A of the heating-and-pressing belt 72 contacting the surface 67C of the heat transfer portion 67 and the surface of the belt guide 69, the fine wear debris 90 is caught by the wear-debris-receiving grooves 110AZ of the pressing portion 110. Therefore, the fine wear debris 90 is prevented from entering into between the first region 110AX of the surface of the pressing portion 110 and the inner surface 72A of the heating-and-pressing belt 72. Thus, failure in forming the toner image can be prevented. That is, image quality can be enhanced.

Further, when the heating-and-pressing belt 72 rotates in the first rotating direction d1 in the printing operation, the fine wear debris 90 gradually moves along the wear-debris-receiving grooves 110AZ from the groove center portion toward both groove end portions by action of the airflow. Therefore, even if the fixing unit 101 is used for a long time, the fine wear debris 90 can be prevented from overflowing from the wear-debris-receiving grooves 110AZ.

As described above, in the fixing unit 101 of the color printer 100 according to the second embodiment, the wear-debris-receiving grooves 110AZ are formed in the second region 110AY of the surface of the pressing portion 110. The wear-debris-receiving grooves 110AZ extend in the V-shape so that the center portion of each wear-debris-receiving groove 110AZ is located upstream in the rotating direction of the heating-and-pressing belt 72, and both end portions of each wear-debris-receiving groove 110AZ are located downstream in the rotating direction of the heating-and-pressing belt 72. The heating-and-pressing belt 72 is stretched around the surface of the belt driving roller 65, the surface 67C of the heat transfer portion 67, the surface of the belt guide 69, and the second region 110AY of the surface of the pressing portion 110. In the printing operation, when the heating-and-pressing belt 72 is driven by the belt driving roller to rotate in the first rotating direction d1 , the inner surface 72A of the heating-and-pressing belt 72 slides on the surface 67C of the heat transfer portion 67, the surface of the belt guide 69 and the surface of the pressing portion 110 while the surface 67C of the heat transfer portion 67, the surface of the belt guide 69 and the surface of the pressing portion 110 are pressed against the inner surface 72A of the heating-and-pressing belt 72.

Therefore, the fixing unit 101 of the color printer 100 provides the same effects as those described in the first embodiment. Further, when the heating-and-pressing belt 72 rotates in the first rotating direction d1 , the fine wear debris caught by the wear-debris-receiving grooves 110AZ can be ejected outside by action of the airflow caused by the rotation of the heating-and-pressing belt 72. Therefore, even if the fixing unit 101 is used for a long time, the fine wear debris 90 can be prevented from overflowing from the wear-debris-receiving grooves 110AZ. Therefore, a lifetime of the fixing unit 16 can be lengthened. As a result, the number of replacement of the fixing unit 16 can be reduced, and user convenience is enhanced.

Further, the belt-width of the heating-and-pressing belt 72 is set to be narrower than the pressing-portion-width of the pressing portion 110, and the heating-and-pressing belt 72 is located at the center portion of the pressing portion 110 in the pressing-portion-widthwise direction. Therefore, even when the fine wear debris 90 is ejected from both groove end portions of the wear-debris-receiving grooves 110AZ of the pressing portion 110, the ejected wear debris is not likely to enter into the nip portion 86 between the outer surface 72B of the heating-and-pressing belt 72 and the surface of the pressure roller 75. Accordingly, it becomes possible to prevent degradation of image quality caused by the fine wear debris 90 entering into the nip portion 86 between the outer surface 72B of the heating-and-pressing belt 72 and the surface of the pressure roller 75.

Modification 1

In the fixing unit 16 (101) described in the first and second embodiments, the outer diameter of the belt driving roller 65 is uniform along the driving-roller-widthwise direction, and the outer diameter of the pressure roller 75 is uniform along the pressure-roller-widthwise direction. The surface 67C of the heat transfer portion 67 is flat along the transfer-portion-widthwise direction, and the surface of the belt guide 69 is flat along the guide-widthwise direction.

Figure 11:
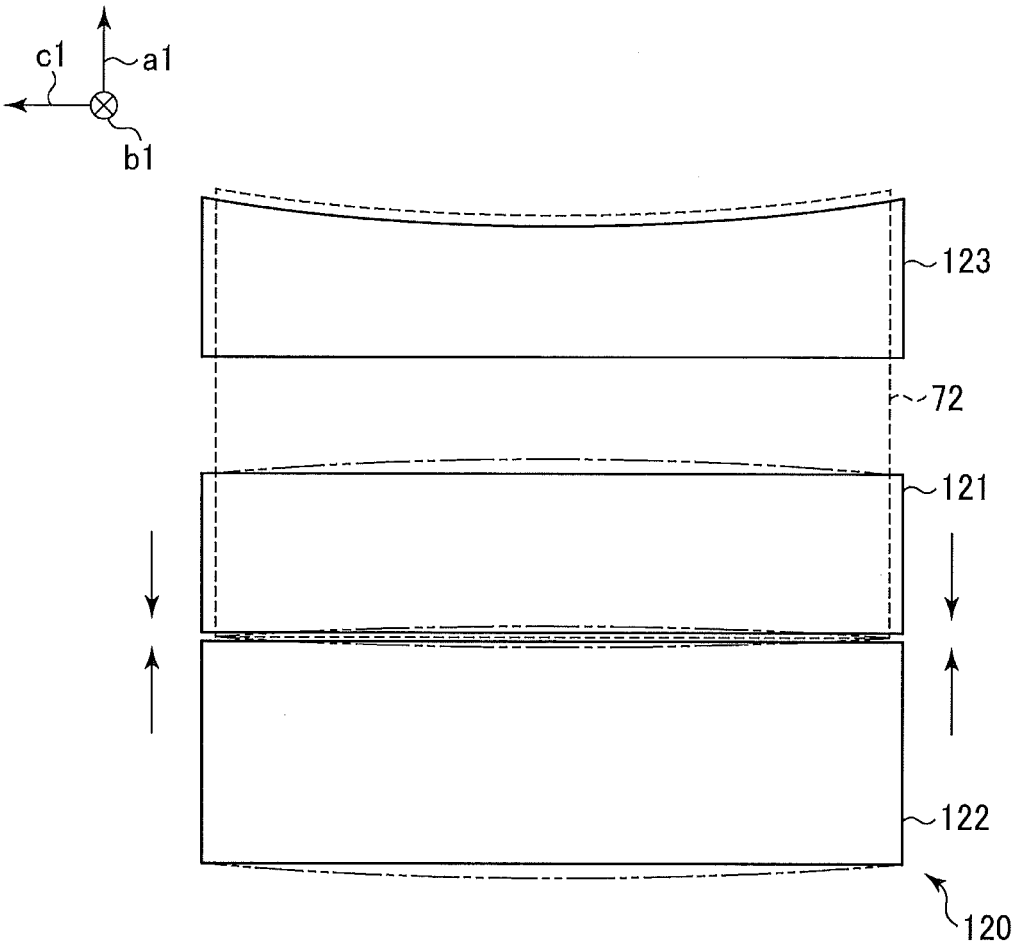
FIG. 11 is a schematic rear view showing a configuration of a fixing unit of Modification 1.

However, the present invention is not limited to such a configuration. For example, FIG. 11 shows a fixing unit 120 according to Modification 1. The fixing unit 120 shown in FIG. 11 includes a belt driving roller 121, a pressure roller 122, a heat transfer portion 123 and a belt guide (not shown). The belt driving roller 121 and the pressure roller 122 both have barrel shapes. In other words, the belt driving roller 121 has an outer diameter which is larger at a center portion in the pressure-roller-widthwise direction than at both end portions in the pressure-roller-widthwise direction. The pressure roller 122 has an outer diameter which is larger at a center portion in the pressure-roller-widthwise direction than at both end portions in the pressure-roller-widthwise direction. The heat transfer portion 123 has an arcuate curved surface which is recessed at a center portion in the unit-widthwise direction (i.e., the transfer-portion-widthwise direction). The belt guide (not shown) has an arcuate curved surface which is recessed at a center portion in the unit-widthwise direction (i.e., the guide-widthwise direction).

In the fixing unit 120 of the second embodiment, the heating-and-pressing belt 72 is stretched around the surface of the belt driving roller 121, the surface of the heat transfer portion 123, the surface of the belt guide, and the surface of the pressing portion 71 (110). It is also preferred to directly bias both pressure roller rotation shafts (not shown) of the pressure roller 122 so that the surface of the pressure roller 122 is pressed against the surface of the belt driving roller 121 and the pressing portion 71 (110) via the heating-and-pressing belt 72.

According to the fixing unit 120 of Modification 1, a close contact property of the inner surface 72A of the heating-and-pressing belt 72 with the surface of the belt driving roller 121 and the surface of the pressing portion 71 (110) can be further enhanced. Further, a close contact property of the inner surface 72A of the heating-and-pressing belt 72 with the surface of the pressure roller 122 can be further enhanced. Moreover, since the surfaces of the heat transfer portion 123 and the belt guide are recessed at respective center portions, the heating-and-pressing belt 72 (stretched around the heat transfer portion 123 and the belt guide) is prevented from being displaced in the belt-widthwise direction when the heating-and-pressing belt 72 rotates in the first rotating direction d1 . As a result, it becomes possible to prevent a corner of either end portion of the heat transfer portion 123 from being strongly pressed against the vicinity of the opening of the heating-and-pressing belt 72. Similarly, it becomes possible to prevent a corner of either end portion of the belt guide from being strongly pressed against the vicinity of the opening of the heating-and-pressing belt 72. Therefore, breakage of the heating-and-pressing belt 72 can be prevented.

In a particular example, it is also preferred to set the width of the belt driving roller 65 (i.e., the belt-driving-roller-width) to be wider than the belt-width, and to provide a pair of flange portions on both ends of the belt driving roller 65. The flange portions have larger diameters than other parts of the belt driving roller 65. In this case, the heating-and-pressing belt 72 is located between both flange portions of the belt driving roller 65. The pressure roller 75 is pressed against a part of the belt driving roller 65 between both flange portions via the heating-and-pressing belt 72. Further, it is also preferred to set the width of the pressure roller 75 (i.e., the pressure-roller-width) to be wider than the belt-width, and to provide a pair of flange portions on both ends of the pressure roller 75. The flange portions have larger diameters than other parts of the pressure roller 75. In this case, the heating-and-pressing belt 72 is located between both flange portions of the pressure roller 75. A part of the pressure roller 75 between both flange portions is pressed against the belt driving roller 65 via the heating-and-pressing belt 72.

With such an arrangement, when the heating-and-pressing belt 72 rotates in the first rotating direction, the heating-and-pressing belt 72 (stretched around the belt driving roller 65) can be prevented from being displaced in the unit-widthwise direction. Therefore, it becomes possible to prevent a corner of either end portion of the belt driving roller 65 from being strongly pressed against the vicinity of the opening of the heating-and-pressing belt 72. Therefore, breakage of the heating-and-pressing belt 72 and the resilient layer 65B of the belt driving roller 65 can be prevented.

Modification 2

In the first and second embodiments, each of the wear-debris-receiving grooves 71BZ (110AZ) has the width which is uniform along the pressing-portion-widthwise direction, and has the depth which is uniform along the pressing-portion-widthwise direction.

However, the present invention is not limited to such a configuration. If a pressing force with which the surface 67C of the heat transfer portion 67 and the surface of the belt guide 69 are pressed against the inner surface 72A of the heating-and-pressing belt 72 is not uniform along the unit-widthwise direction, it is preferred to set the widths and/or depths of the wear-debris-receiving grooves 71BZ (110AZ) to be larger or deeper at a portion where a larger pressing force is applied.

As described in Modification 1, when the heat transfer portion 123 or the belt guide has the arcuate shape along the unit-widthwise direction (see FIG. 11), a pressing force with which the surface 67C of the heat transfer portion 67 and the surface of the belt guide 69 are pressed against the inner surface 72A of the heating-and-pressing belt 72 increases from the center portion toward both openings of the heating-and-pressing belt 72 in the unit-widthwise direction (i.e., the belt-widthwise direction).

Figure 12:
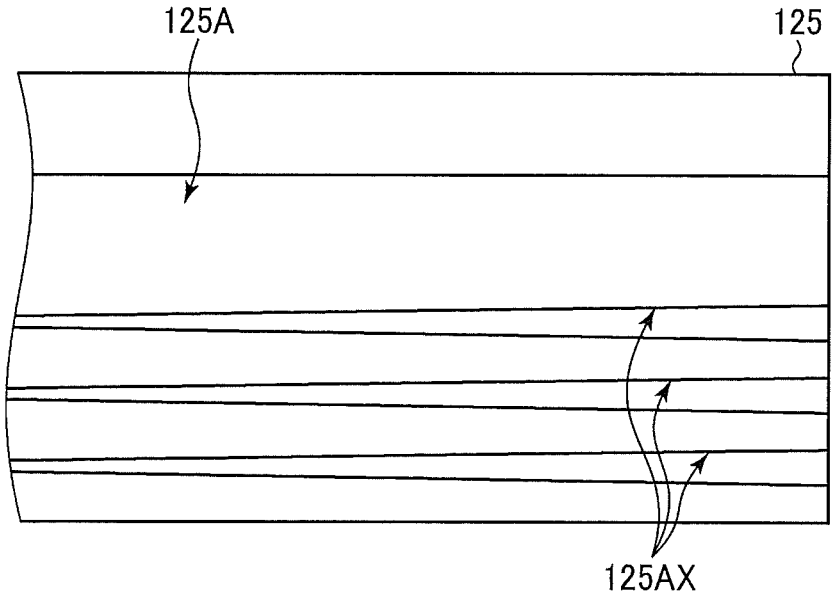
FIG. 12 is a schematic bottom view showing a configuration of a pressing portion of Modification 2.

FIG. 12 shows a pressing portion 125 of Modification 2. Wear-debris-receiving grooves 125AX are formed on the surface 125A of the pressing portion 125. In Modification 2, the widths of the wear-debris-receiving grooves 125AX gradually increase from the groove center portion (corresponding to the center portion of the inner surface 72A of the heating-and-pressing belt 72) toward both groove end portions (corresponding to both openings of the heating-and-pressing belt 72). In this case, the depths of the wear-debris-receiving grooves 125AX are uniform in the unit-widthwise direction.

Further, it is also preferred that the depths of the wear-debris-receiving grooves 125AX gradually increase from the groove center portion (i.e., a first part) toward both groove end portion (i.e., a second part). In this case, the widths of the wear-debris-receiving grooves 125AX are uniform in the unit-widthwise direction.

Furthermore, it is also preferred that the widths and depths of the wear-debris-receiving grooves 125AX gradually increase from the groove center portion (i.e., a first part) toward both groove end portion (i.e., a second part).

In this regard, even when the surface 67C of the heat transfer portion 67 is flat along the transfer-portion-width-wise direction, there may be cases, for example, where the pressing force with which the surface 67C of the heat transfer portion 67 is pressed against the inner surface 72A of the heating-and-pressing belt 72 is not uniform due to arrangement intervals or kinds of the biasing coil springs 82 biasing the heat transfer portion 67. In such cases, it is preferred to set the widths and/or depths of the wear-debris-receiving grooves 71BZ (110AZ) to be larger or deeper at a portion where a larger pressing force is applied.

In this configuration, there is a possibility that an amount of the fine wear debris 90 generated at a part of the inner surface 72A of the heating-and-pressing belt 72 strongly pressed against the surface 67C of the heat transfer portion 67 and the surface of the belt guide 69 may increase. However, such fine wear debris 90 can be reliably caught by the wear-debris-receiving grooves 125AX.

Modification 3

In the above described first embodiment, the heating-and-pressing belt 72 has a narrower width (i.e., the belt-width) than the pressing-portion-width of the pressing portion 71 around which the heating-and-pressing belt 72 is stretched.

However, the present invention is not limited to such a configuration. The heating-and-pressing belt 72 may have a wider width (i.e., the belt-width) than the pressing-portion-width of the pressing portion 71 around which the heating-and-pressing belt 172 is stretched. In this case, both opening of the heating-and-pressing belt 172 may be located outside both ends of the pressing portion 71 in the pressing-portion-widthwise direction. When the pressing portion 71 has the wear-debris-receiving grooves 71BZ that extend linearly (see FIG. 5), the fine wear debris 90 is not ejected via the groove end portions. Therefore, there is no disadvantage even if the heating-and-pressing belt 172 is wider than the pressing portion 71.

Modification 4

In the above described second embodiment, the V-shaped wear-debris-receiving grooves 110AZ are formed on the surface of the pressing portion 110.

Figure 13A:
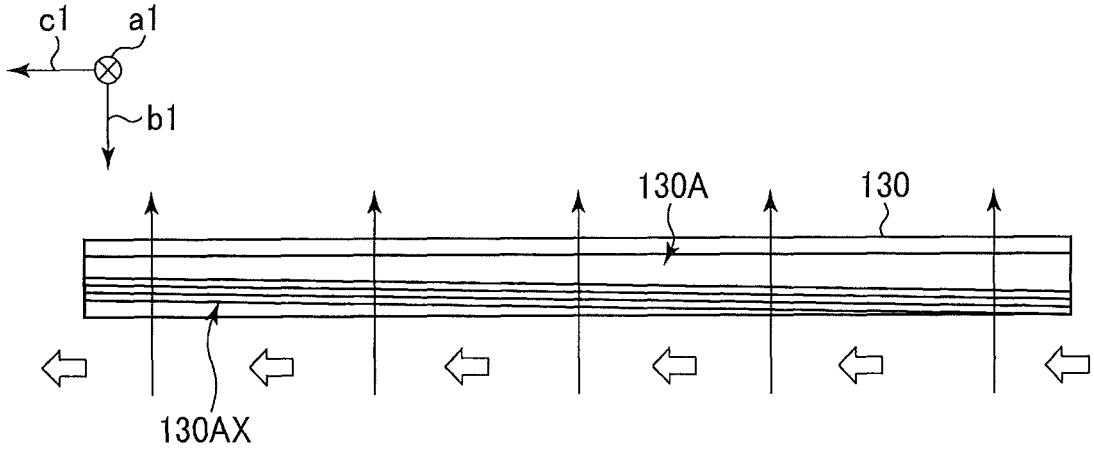
FIGS. 13A and 13B are schematic bottom views showing a configuration of the pressing portion of Modification 3.
Figure 13B:
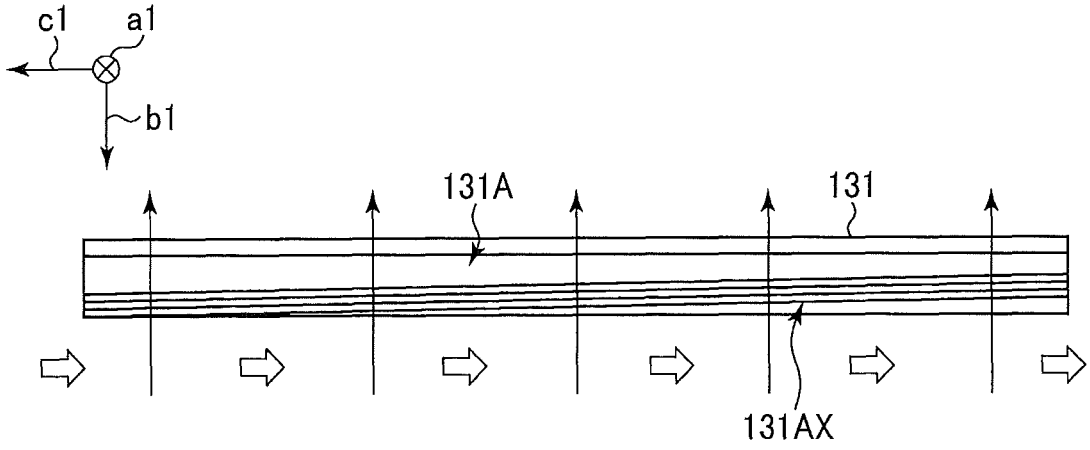

However, the present invention is not limited to such a configuration. FIG. 13A shows a pressing portion 130 of Modification 4. A plurality of wear-debris-receiving grooves 130AX are formed on a second region of a surface 130A of the pressing portion 130. The wear-debris-receiving grooves 130AX extends linearly and obliquely with respect to the pressing-portion-widthwise direction (i.e., the unit-width-wise direction). One groove end portion (i.e., a left end shown in FIG. 13A) is located upstream in the rotating direction of the heating-and-pressing belt 72, and the other groove end portion (i.e., a right end shown in FIG. 13A) is located downstream in the rotating direction of the heating-and-pressing belt 72. FIG. 13B shows another example of a pressing portion 131 of Modification 4. In the example shown in FIG. 13B, the wear-debris-receiving grooves 131A extends so that one groove end portion (i.e., a left end shown in FIG. 13A) is located downstream in the rotating direction of the heating-and-pressing belt 72, and the other groove end portion (i.e., a right end shown in FIG. 13A) is located upstream in the rotating direction of the heating-and-pressing belt 72. With such a configuration, the same effects as those described in the second embodiment can be obtained.

In the examples shown in FIGS. 13A and 14B, each wear-debris-receiving groove 130AX preferably has a length such that at least one groove end portion of the wear-debris-receiving groove 130AX (located downward in the heating-and-pressing belt 72) protrudes from the opening of the heating-and-pressing belt 72. This is because the fine wear debris is ejected via the groove end portion of the wear-debris-receiving groove 130AX located downward in the heating-and-pressing belt 72.

With such a configuration, the fine wear debris 90 carried to the pressing portion 130 (131) can be caught by the wear-debris-receiving grooves 130AX (131AX), and can be ejected from the wear-debris-receiving grooves 130AX (131AX) by the rotation of the heating-and-pressing belt 72.

Modification 5

In the above described first and second embodiments, the heating section 60 (150) of the fixing unit (16, 101) includes the pressing portion 71 (110).

However, the present invention is not limited to such a configuration. The heating section of the fixing unit may include a roller with an internal heat source for heating the recording sheet 5 (referred to as a heat roller), and a temperature sensor for detecting a surface of the heat roller. In this case, the pressure section of the fixing unit may include the pressure roller, the pressing portion (having the wear-debris-receiving grooves formed on the surface thereof) and the belt guide. A belt (referred to as a pressure belt) may be stretched around the surface of the pressure roller, the surface of the pressing portion and the surface of the belt guide.

Further, the surface of the heat roller may be pressed against the surface of the pressure roller and the surface of the pressing portion via the pressure belt so as to form a nip portion. In other words, the pressure belt and the pressing portion are provided in the pressure section of the fixing unit. The fixing unit configured in such a manner provides the same effects as those of the fixing unit 16 (101) described in the first and second embodiments.

In addition, the heating section of the fixing unit may include the belt driving roller 65, the heat transfer portion 67, and the heating-and-pressing belt 72 stretched around the surface of the belt driving roller 65 and the surface of the heat transfer portion 67. The heating section may include a pushing portion located at a predetermined position downstream of the heat transfer portion 67 in the rotating direction of the heating-and-pressing belt 72 and upstream of the belt driving roller 65. The pushing portion has a surface on which wear-debris-receiving grooves are formed, and the surface is pressed against the inner surface 72A of the heating-and-pressing belt 72. The heating section may further include a temperature sensor that detects the temperature of the heating-and-pressing belt 72 from the outer surface 72B side. The pressure section may further includes the pressure roller 75. The pressure roller 75 is pressed against the surface of the belt driving roller 65 via the heating-and-pressing belt 72 so to form a nip portion.

In another example, the heating section of the fixing unit may include a heat roller with an internal heat source, a temperature sensor for detecting a surface temperature of the heat roller. The pressure section of the fixing unit may include a pressure roller, a belt guide, and a pressure belt stretched around the surface of the pressure roller and the surface of the belt guide. The pressure section may further include a pushing portion located downstream of the belt guide and upstream of the pressure roller in a rotating direction of the pressure belt. The pushing portion has a surface on which wear-debris-receiving grooves are formed, and the surface is pressed against the inner surface of the pressure belt. The surface of the heat roller is pressed against the pressure roller via the pressure belt so as to form a nip portion.

The fixing unit of this modification may not include the pressing portion for forming the nip portion, but may include a pushing portion with the wear-debris-receiving grooves exclusive for catching the fine wear debris 90. With such a configuration, the fine wear debris 90 generated by wear of the inner surface 72A of the heating-and-pressing belt 72 or the surface of the pressure belt can be caught by the wear-debris-receiving grooves of the pushing portion. Therefore, the fine wear debris 90 is prevented from entering into between the inner surface of the heating-and-pressing belt and the belt driving roller, or between the inner surface of the pressure belt and the pressure roller. Accordingly, as described in the first and second embodiments, failure in forming the toner image on the surface of the recording sheet 5 can be prevented, and image quality can be enhanced.

Modification 6

In the above described first and second embodiments, a plurality of (for example, three) wear-debris-receiving grooves 71BZ (110AZ) are formed on the surface of the pressing portion 71 (110) of the fixing unit 16 (101).

The present invention is not limited to such a configuration. It is also possible to provide a single wear-debris-receiving groove having a relatively wide width or having a relatively deep depth on the surface of the pressing portion 71 (110) of the fixing unit 16 (101). The wear-debris-receiving groove may linearly extend, or may extend in a V-shape. It is also possible to provide four or more wear-debris-receiving grooves which are arranged along the rotating direction of the heating-and-pressing belt 72 on the surface of the pressing portion 71 (110) of the fixing unit 16 (101). The wear-debris-receiving grooves may linearly extend, or may extend in a V-shape. With such configurations, the fine wear debris 90 generated by wear of the inner surface 72A of the heating-and-pressing belt 72 can be caught by the wear-debris-receiving groove(s) of the pressing portion 71 (110).

Further, at least one wear-debris-receiving groove may be provided on the surface 67C of the heat transfer portion 67 in a similar manner to the wear-debris-receiving groove(s) of the pressing portion 71 (110, 125, 130, 131). More specifically, the wear-debris-receiving groove may be located on a relatively downstream part of the surface 67C in the rotating direction of the heating-and-pressing belt 72. With such a configuration, when the fine wear debris 90 is generated by sliding contact of the inner surface 72A of the heating-and-pressing belt 72 with the surface 67C of the heat transfer portion 67, a part of the fine wear debris 90 is caught by the wear-debris-receiving groove of the heat transfer portion 67. Therefore, the amount of the fine wear debris 90 carried downstream of the heat transfer portion 67 in the rotating direction of the heating-and-pressing belt 72 can be reduced.

Furthermore, at least one wear-debris-receiving groove may be provided on the edge portion of the belt guide 69 in a similar manner to the wear-debris-receiving groove(s) of the pressing portion 71 (110, 125, 130, 131). In this case, the wear-debris-receiving groove may be provided on a downstream edge portion of the plate portion 69A of the belt guide 69 in the rotating direction of the heating-and-pressing belt 72. The edge portion is pressed against the inner surface 72A of the heating-and-pressing belt 72. With such a configuration, when the fine wear debris 90 is generated by sliding contact of the inner surface 72A of the heating-and-pressing belt 72 with the surface 67C of the heat transfer portion 67 and the surface of the belt guide 69, a part of the fine wear debris is caught by the wear-debris-receiving groove of the belt guide 69. Therefore, the amount of the fine wear debris 90 carried downstream of the belt guide 69 in the rotating direction of the heating-and-pressing belt 72 can be reduced.

In this modification, the wear-debris-receiving groove may be provided on one of the surface of the heat transfer portion 67 and the surface of the belt guide 69. Further, the wear-debris-receiving groove may be provided on both of the surface of the heat transfer portion 67 and the surface of the belt guide 69. With such a configuration, the amount of the fine wear debris 90 caught by the wear-debris-receiving grooves can be increased.

According to this modification, the lifetime of the fixing unit 16 (101) can be further lengthened. Further, the number of replacement of the fixing unit 16 (101) can be reduced, and user convenience can be enhanced.

Further, in this modification, in the case where the wear-debris-receiving groove is formed on the surface 67C of the heat transfer portion 67, the surface 67C may be coated with resin so as to enhance a close contact property with the inner surface 72A of the heating-and-pressing belt 72. In the case where the wear-debris-receiving groove is formed on the surface of the belt guide 69, the surface of the belt guide 69 may be coated with resin so as to enhance a close contact property with the inner surface 72A of the heating-and-pressing belt 72. This arrangement allows for reduction of wear of the inner surface 72A of the heating-and-pressing belt 72 contacting the surface 67C of the heat transfer portion 67 and the surface of the belt guide 69. Therefore, the amount of the fine wear debris 90 can be reduced. Thus, the lifetime of the fixing unit 16 (101) as well as the lifetime of the heating-and-pressing belt 72 can be further lengthened, and user convenience can be enhanced.

Modification 7

In the above described first and second embodiments, description has been made of the fixing unit 16 (101) detachably mounted to the color printer 1 (100) as shown in FIG. 1.

However, the present invention is not limited to such a configuration. The present invention is also applicable to a fixed (i.e., non-detachable) fixing unit mounted to the color printer 1 (100). Further, the present invention is also applicable to various kinds of fixing devices detachably or non-detachably mounted to an image forming apparatus such as a monochrome electrophotographic printer, a multifunction printer, a facsimile machine, a complex machine, a copier or the like.

Modification 8

In the above described first and second embodiments, description has been made of the color printer 1 (100) as shown in FIG. 1.

However, the present invention is not limited to such a color printer. The present invention is also applicable to various kinds of image forming apparatuses such as a monochrome electrophotographic printer, a multifunction printer, a facsimile machine, a complex machine, a copier or the like.

Modification 9

In the above described first and second embodiments, recording sheet 5 has been described as an example of a recording medium, and is heated and pressed for image fixing as shown in, for example, FIG. 2.

However, the present invention is not limited to such a configuration. Various kinds of media such as an OHP sheet, a letter sheet or a disk-like medium may be used.

Modification 10

In the above described first and second embodiments, the heating-and-pressing belt 72 having an endless shape is used to press the medium so as to fix an image to the recording sheet 5 as shown in, for example, FIG. 2.

However, the present invention is not limited to such a configuration. Various kinds of belts may be used to press the recording medium. For example, the heating-and-pressing belt 72 whose width is wider than the pressing-portion-width as described in Modification 3 may be used. Further, the pressure belt as described in Modification 5 may be used. Furthermore, the heating-and-pressing belt whose surface is entirely coated with resin (i.e., a releasing layer) may be used.

Modification 11

In the above described first and second embodiments, the belt driving roller 65 is used as a roller around which the heating-and-pressing belt is stretched, and rotates to drive the heating-and-pressing belt in a predetermined rotating direction as shown in, for example, FIG. 2.

However, the present invention is not limited to such a configuration. Various kinds of rollers may be used. For example, the belt driving roller having flange portions on both ends thereof as described in Modification 1 may be used. Further, the pressure roller (around which the pressure roller is stretched) as described in Modification 5 may be used.

Modification 12

In the above described first and second embodiments, the pressing portion 71 (110) is provided upstream of the belt driving roller 65 in the rotating direction of the heating-and-pressing belt 72 and having the surface pressed against the inner surface 72A of the heating-and-pressing belt 72 as shown in, for example, FIG. 2.

However, the present invention is not limited to such a configuration. Various kinds of pressing portions (for example, the heat transfer portion 67, the belt guide 69 or the like) may be used.

Modification 13

In the above described first and second embodiments, the wear-debris-receiving grooves 71BZ (110AZ) extend linearly or in the V-shape on the surface of the pressing portion and having an elongated shape in the belt-widthwise direction as shown in, for example, FIGS. 3 and 7.

However, the present invention is not limited to such a configuration. The wear-debris-receiving grooves may extend in a U-shape, a circular-arc shape or an arcuate shape so that groove end portions of each groove are located downstream of a groove center portion in the rotating direction of the heating-and-pressing belt 72. The wear-debris-receiving grooves may serve as a groove for adjusting a coating amount of grease or oil for ensuring a sliding property with the inner surface 72A of the heating-and-pressing belt 72. The wear-debris-receiving grooves may have widths or depths that vary along the extending direction of the grooves as described in Modification 2. Further, a single wear-debris-receiving groove may be used as described in Modification 6.

Modification 14.

In the above described first and second embodiments, the surface (i.e., an outer circumferential surface) of the pressure roller 75 is pressed against the belt driving roller 65 and the pressing portion 71 via the heating-and-pressing belt 72 as shown in, for example, FIG. 2.

However, the present invention is not limited to such a configuration. Various kinds of rollers may be used. For example, the pressure roller having flange portions on the both end portions as described in Modification 1, and the pressure roller as described in Modification 5 may be used.

Modification 15

In the above described first and second embodiments, the heat transfer portion 67 and the belt guide 69 (i.e., pressing portions other than the pressing portion) are pressed against the inner surface 72A of the heating-and-pressing belt 72 with a uniform pressing force in the belt-widthwise direction so that the heat transfer portion 67 and the belt guide 69 slides on the inner surface 72A of the heating-and-pressing belt 72 as shown in, for example, FIG. 1.

However, the present invention is not limited to such a configuration. Various kinds of pushing portions such as the belt guide as described in Modification 5 may be used as well as.

While the preferred embodiments of the present invention have been illustrated in detail, it should be apparent that modifications and improvements may be made to the invention without departing from the spirit and scope of the invention as described in the following claims.

What is claimed is:

1. A fixing device comprising:

a belt having an endless shape;

a heater provided on an inner surface side of the belt;

a pressure member that contacts the belt and forms a nip portion; and a pressing portion including a first region that forms the nip portion and a second region provided outside and upstream of the nip portion in a rotating direction of the belt, the second region having a surface and a groove formed on the surface;

wherein the groove extends throughout an entire width of the belt in a widthwise direction of the belt, and extends past outermost edges of the belt in the widthwise direction of the belt.

2. The fixing device according to claim 1, further comprising a nip-forming portion that contacts the inner surface of the belt and forms the nip portion between the nip-forming portion and the pressure member via the belt.

3. The fixing device according to claim 2, wherein the nip-forming portion includes a driving roller that contacts the inner surface of the belt, the driving roller rotating to rotate the belt.

4. The fixing device according to claim 2, wherein the groove-formed portion is located downstream of the heater in the rotating direction of the belt.

5. The fixing device according to claim 1, wherein the heater contacts the inner surface of the belt.

6. The fixing device according to claim 1, wherein the pressing portion has a surface coated with resin.

7. The fixing device according to claim 1, wherein the second region has a plurality of grooves on the surface, the plurality of grooves being arranged in a direction from upstream to downstream along the rotating direction of the belt.

8. The fixing device according to claim 1, wherein the groove has an angulated edge on the surface of the pressing portion.

9. The fixing device according to claim 1, wherein:

both end portions of the pressing portion protrude from both openings of the belt;

the surface of the pressing portion is pressed against the inner surface of the belt;

at least one of both end portions of the groove in a widthwise direction of the belt is located downstream in a rotating direction of the belt with respect to a center portion of the groove in the widthwise direction of the belt; and the at least one of both end portions of the groove protrudes from at least one of the openings of the belt.

10. The fixing device according to claim 1, wherein the second region is formed so that the groove linearly extends on the surface, an extending direction of the groove being parallel to a widthwise direction of the belt.

11. The fixing device according to claim 1, wherein the second region is formed so that the groove linearly extends on the surface, an extending direction of the groove being inclined with respect to a widthwise direction of the belt.

12. The fixing device according to claim 1, wherein:

the second region includes a first part and a second part; and the first part has a narrower width or a deeper depth than the second part.

13. An image forming apparatus comprising:

the fixing device according to claim 1.

14. The fixing device according to claim 1, wherein the pressing portion is biased toward the belt by a biasing member.

15. The fixing device according to claim 1, wherein:

the pressing portion includes a pressing portion body and a resilient layer; and the groove is formed on the resilient layer.

16. The fixing device according to claim 1, wherein the second region is disposed between the nip-forming portion and the heater.

17. The fixing device according to claim 1, wherein the pressing portion includes a pressing portion main body and a resilient layer covering the pressing portion main body.

18. The fixing device according to claim 17, wherein a thickness of the resilient layer is thicker in the second region than in the first region.

* * * * *